US008677715B2

(12) United States Patent
Giorio

(10) Patent No.: US 8,677,715 B2
(45) Date of Patent: Mar. 25, 2014

(54) BUILDING ELEMENTS AND BUILDING SYSTEM USING SUCH ELEMENTS

(75) Inventor: Giorgio Giorio, Jarohnevice (CZ)

(73) Assignee: Tekno Design S.R.O., Jarohnevice (Kromeriz) (CZ)

( * ) Notice: Subject to any disclaimer, the term of this patent is extended or adjusted under 35 U.S.C. 154(b) by 0 days.

(21) Appl. No.: 13/519,258

(22) PCT Filed: Nov. 26, 2010

(86) PCT No.: PCT/IB2010/055457

§ 371 (c)(1),
(2), (4) Date: Jun. 26, 2012

(87) PCT Pub. No.: WO2011/080619

PCT Pub. Date: Jul. 7, 2011

(65) Prior Publication Data

US 2012/0291366 A1 Nov. 22, 2012

(30) Foreign Application Priority Data

Dec. 28, 2009 (EP) ..... 09180822

(51) Int. Cl.
*E04C 2/04* (2006.01)
*E04C 1/00* (2006.01)

(52) U.S. Cl.
USPC ..... 52/608; 52/604; 52/603; 52/98; 52/100

(58) Field of Classification Search
CPC ..... E04C 1/00; E04C 2/04
USPC ..... 52/608, 612, 603, 604, 607, 503, 505, 52/245, 98, 100
See application file for complete search history.

(56) References Cited

U.S. PATENT DOCUMENTS

| | | | | | |
|---|---|---|---|---|---|
| 828,930 | A | * | 8/1906 | Crampton | 52/587.1 |
| 964,160 | A | * | 7/1910 | Hammett | 52/590.1 |
| 2,472,363 | A | * | 6/1949 | Blackinton | 446/127 |
| 3,412,513 | A | * | 11/1968 | Gosele | 52/144 |
| 4,073,111 | A | * | 2/1978 | Warren | 52/407.1 |

(Continued)

FOREIGN PATENT DOCUMENTS

| | | | |
|---|---|---|---|
| DE | 8618890 | U1 | 9/1986 |
| DE | 19624405 | A1 | 1/1998 |

(Continued)

OTHER PUBLICATIONS

PCT/ISA/220—Notification of Transmittal of the International Search Report and the Written Opinion of the International Searching Authority, or the Declaration, mailed on Jan. 31, 2011, with PCT/ISA/210—International Search Report completed on Jan. 18, 2011 and mailed on Jan. 31, 2011, and PCT/ISA/237—Written Opinion of the International Searching Authority mailed on Jan. 31, 2011.

*Primary Examiner* — Phi A
(74) *Attorney, Agent, or Firm* — Heslin Rothenberg Farley & Mesiti P.C.; Victor A. Cardona, Esq.

(57) ABSTRACT

A building element is in the form of hollow brick having a plane major face and dovetailed projections on an opposite major face for slotting together with similar building elements for the construction of masonry structures. The building element has internal through cavities for housing of operative connections of distribution systems and the like, arranged according to an array parallel to said plane major face, which is formed with references for identification from outside of each through cavity.

16 Claims, 30 Drawing Sheets

(56) References Cited

U.S. PATENT DOCUMENTS

| | | | | |
|---|---|---|---|---|
| 4,896,999 | A * | 1/1990 | Ruckstuhl | 405/286 |
| 5,471,808 | A * | 12/1995 | De Pieri et al. | 52/603 |
| 6,571,525 | B2 * | 6/2003 | Coleman | 52/592.5 |
| 6,579,038 | B1 * | 6/2003 | McAllister et al. | 405/16 |
| 7,694,485 | B1 * | 4/2010 | Siener | 52/590.2 |
| 7,823,360 | B1 * | 11/2010 | Cottle | 52/608 |

FOREIGN PATENT DOCUMENTS

| | | | |
|---|---|---|---|
| DE | 20105370 | U1 | 6/2001 |
| EP | 0186109 | A2 | 7/1986 |
| EP | 1808542 | A1 | 7/2007 |
| GB | 669750 | A | 4/1952 |
| GB | 783527 | | 9/1957 |
| GB | 1431766 | | 4/1976 |
| GB | 2255117 | A | 10/1992 |
| JP | 03-129028 | C | 6/1991 |
| WO | 92/19827 | | 11/1992 |
| WO | 2005/035898 | A1 | 4/2005 |
| WO | 2007/065961 | A1 | 6/2007 |
| WO | 01/77456 | A1 | 10/2011 |

* cited by examiner

BUILDING ELEMENTS AND BUILDING SYSTEM USING SUCH ELEMENTS

CROSS REFERENCE TO RELATED APPLICATIONS

This application is a national stage of PCT International Application No. PCT/IB2010/055457 filed on Nov. 26, 2010, and published in English on Jul. 7, 2011 as WO 2011/080619 A1, which claims priority from European patent application No. 09180822.0 filed on Dec. 28, 2009, the entire disclosures of which are incorporated herein by reference.

FIELD OF THE INVENTION

The present invention relates to building elements generally in the form of hollow bricks and corresponding accessories, that can be used for building external or internal load-bearing wall structures, curtain-wall structures, partition-wall structures, etc.

STATE OF THE ART

Known to the art are building elements in the form of hollow bricks, which are designed to be slotted into one another, typically in the form of dovetailed projections, which render laying simpler and faster, ensuring proper alignment as well as a stiff and compact structure prior to their permanent joining performed in a conventional way via application of mortar or similar cementitious binders.

For instance, the document No. GB-A-783527 describes a building element of the above sort having a major face and dovetailed projections on the opposite major face for coupling in a modular way with similar building elements. Following upon coupling between the dovetailed projections, free spaces are defined for passage of tie rods or reinforcement elements.

Similar building elements are described and illustrated in the documents Nos. JP-C-1986132, GB-A-1431766 and WO-01/77456, in which the building element is formed with through cavities and holes for engagement of reference pins for vertical alignment with similar building elements.

The above known solutions do not tackle the problem, nor do they hence propose any solutions, as regards application, of systems such as electric wiring and/or plumbing set into the structure obtained following upon laying of the building elements. This requires chases or clefts to be made in the external faces of the assembled building elements to enable access to corresponding internal cavities and insertion of wireways, pipes, ducts, and the like.

Document WO-2007/065961 discloses a building element in the form of a hollow brick corresponding to the pre-characterizing part co claim 1, having a pair of through cavities extending parallelly to the plane of its major faces and intended for insertion of operative connections vertically from above. Such cavities can not, and actually do not need, to be identified from the exterior of the brick.

SUMMARY OF THE INVENTION

Considering the problem set forth above, the object of the present invention is to provide a building element of the type defined at the beginning of the present description, not only structured so as to guarantee high simplicity, rapidity, and precision of laying but also shaped in such a way as to render extremely practical and convenient the subsequent operations of insertion of wireways, pipes, ducts, or the like within the structure made following upon laying.

According to the invention, the above purpose is achieved thanks to a building element of the type defined in the preamble of claim 1, the primary characteristic of which lies in the fact that the aforesaid through cavities are arranged according to an array parallel to the plane major face of the brick, and in the fact that said plane face is formed with references for identification from outside of each of said through cavities.

In a preferred embodiment of the invention, the plane major face of the brick has ribbings, and the aforesaid references are constituted by interruptions of said ribbings aligned axially with the aforesaid through cavities.

The building element according to the invention moreover conveniently has at least one pair of, top and bottom, recesses that can be engaged by respective pin elements for vertical centring with similar bricks in the course of laying.

Conveniently, the building element according to the invention can be provided in two different embodiments, one of smaller thickness, in the region of 125 mm, and one of larger thickness, in the region of 250 mm. In the latter case, the building element moreover has a pair of further through cavities for insertion of possible reinforcement elements, and is hence particularly suited for building antiseismic masonry structures.

The subject of the invention is likewise a building system that uses a plurality of elements of the aforesaid type and further includes auxiliary members in the form of vertical centring elements and of horizontal spacer elements, as well as accessory members for the possible closing of the compartments comprised between the dovetailed projections of the bricks in the case where they have not been slotted into other bricks.

BRIEF DESCRIPTION OF THE DRAWINGS

The invention will now be described in detail with reference to the annexed drawings, which are provided purely by way of non-limiting example and in which.

DETAILED DESCRIPTION OF THE INVENTION

Figure 1:
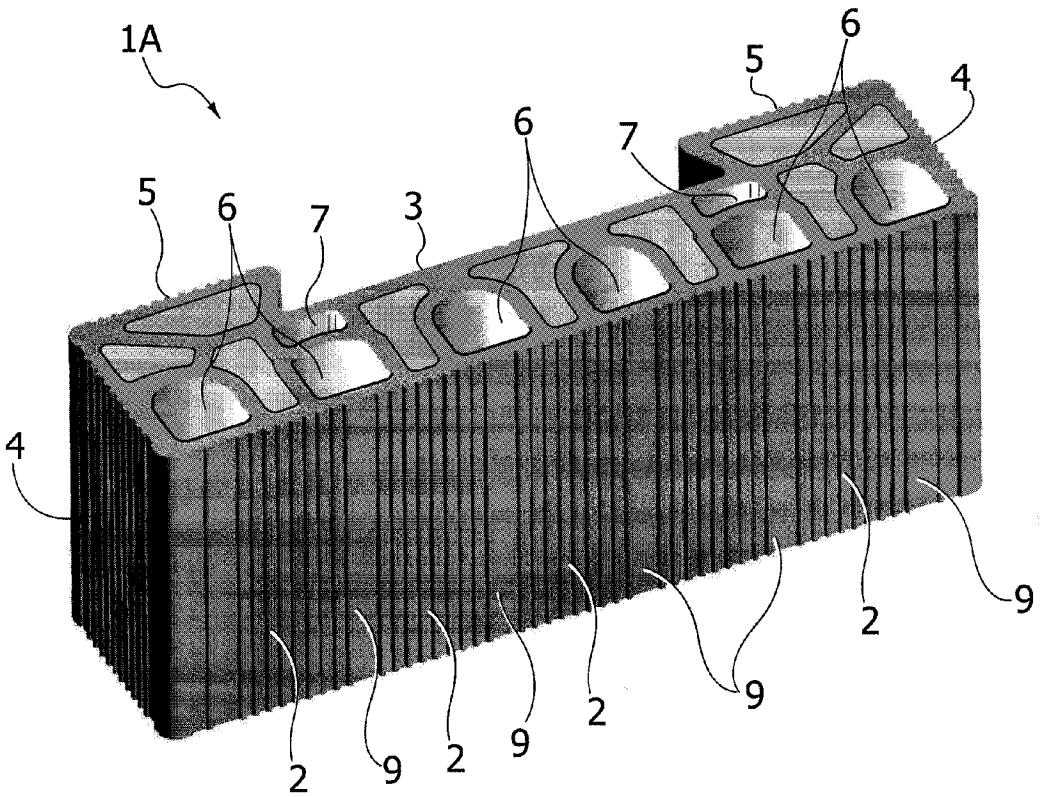
FIG. 1 is a schematic perspective view of a building element according to a first embodiment of the invention.
Figure 2:
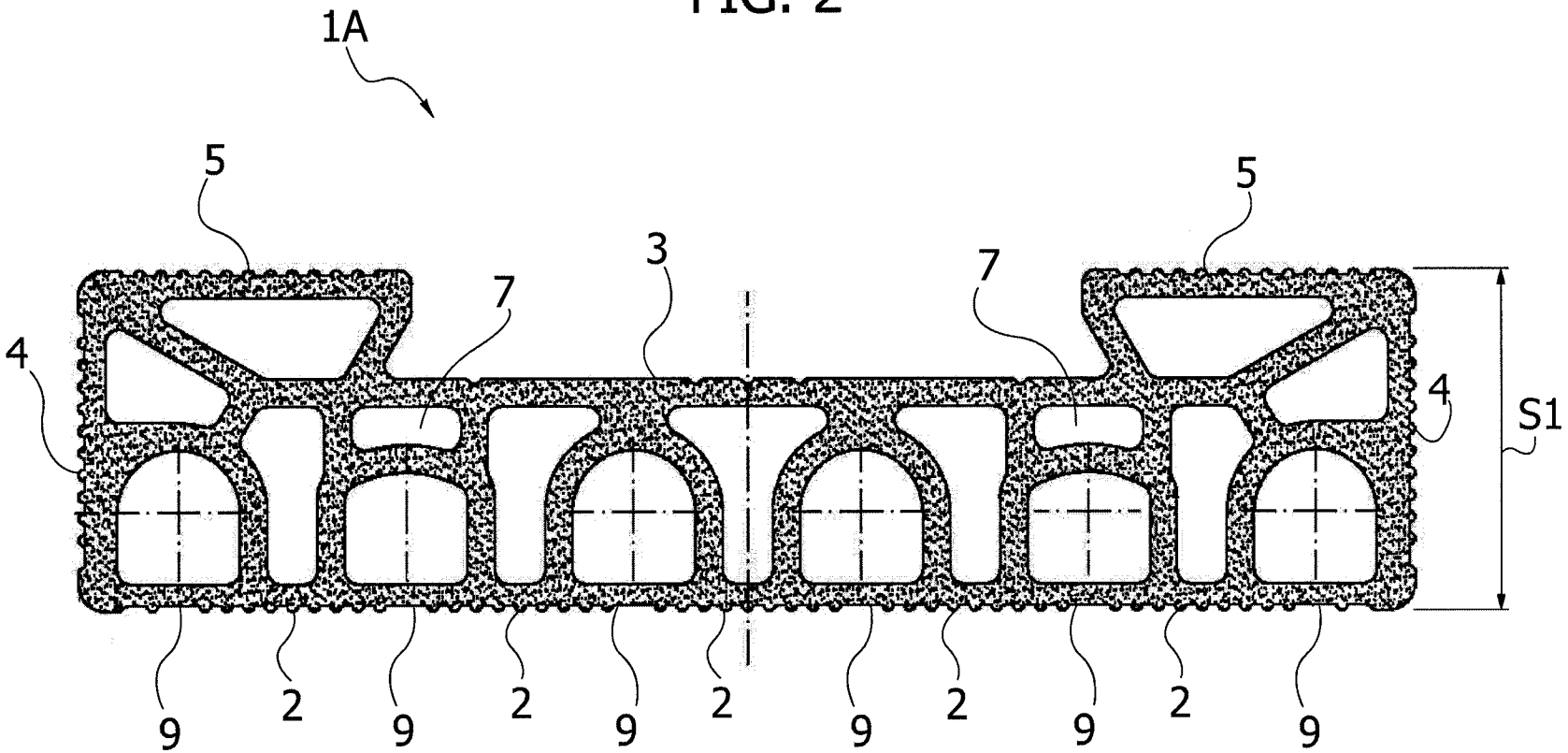
FIG. 2 is a horizontal cross-sectional view of the building element of FIG. 1.
Figure 3:
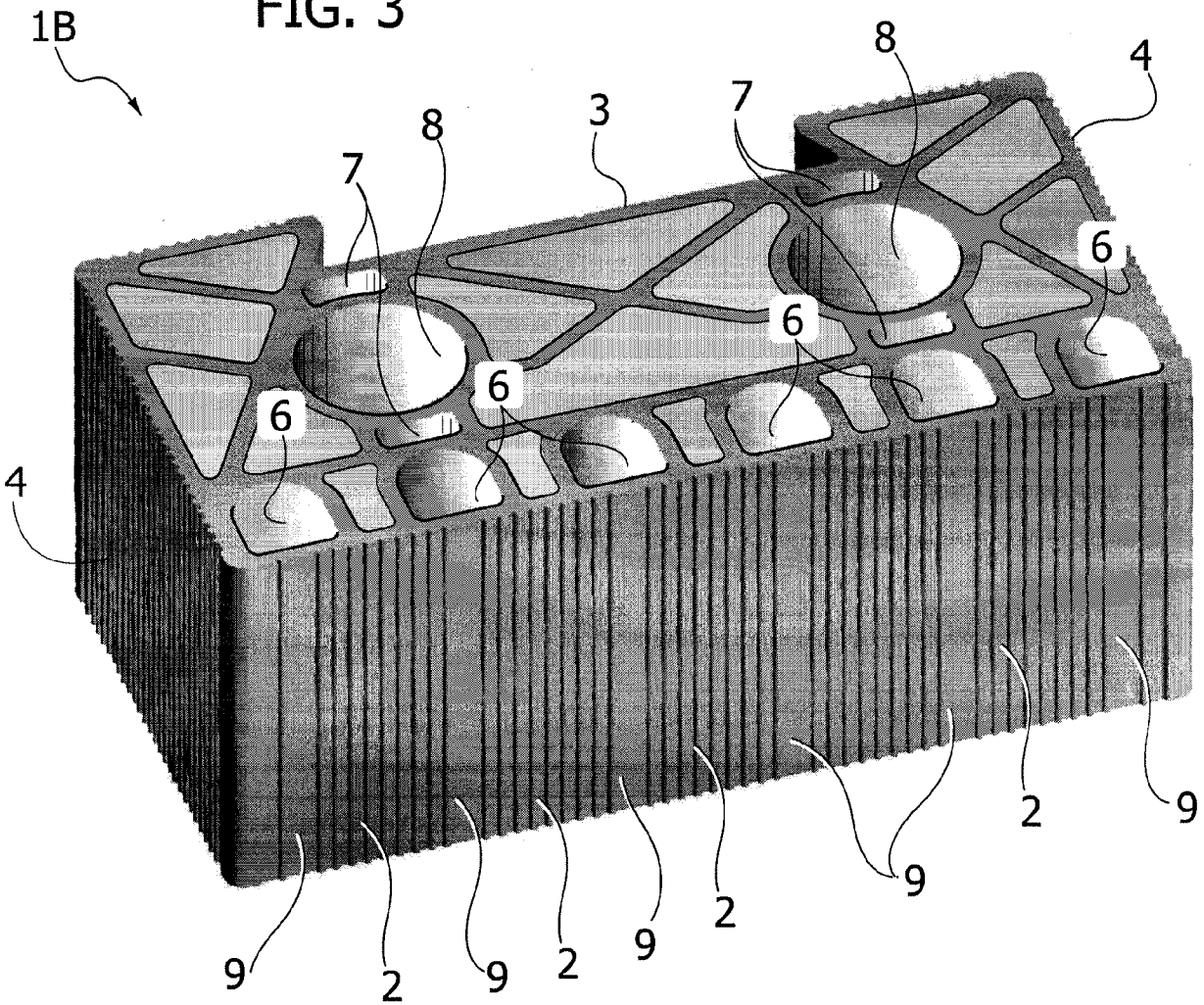
FIG. 3 is a schematic perspective view similar to FIG. 1 of a second embodiment of the building element.
Figure 4:
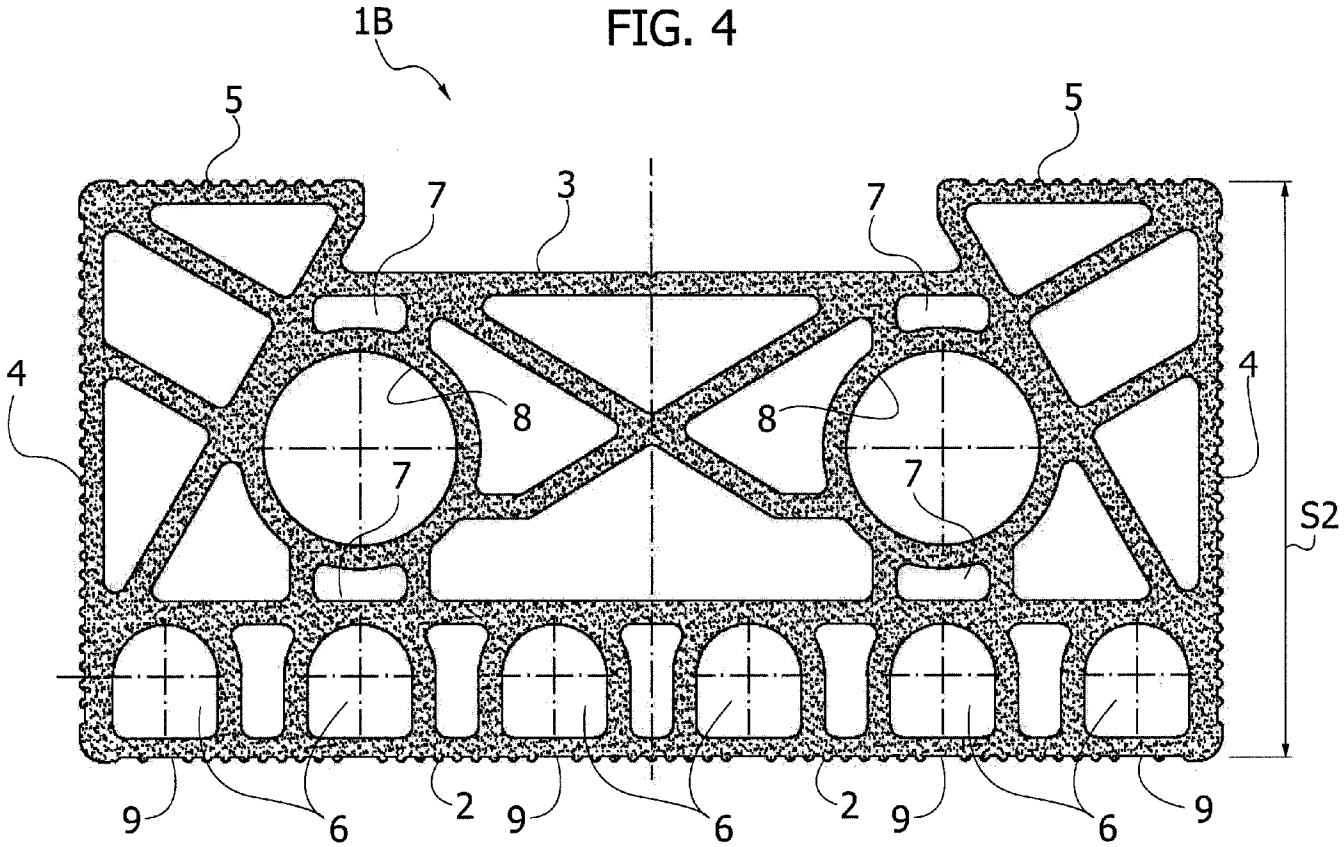
FIG. 4 is a horizontal cross-sectional view of the building element of FIG. 3.

The building elements according to the invention can present the two basic configurations designated, respectively, by 1A in FIGS. 1 and 2 and by 1B in FIGS. 3 and 4.

In both cases, each building element 1A, 1B, made of clay or other suitable material, has the general shape of a hollow brick with a plane major face 2 and an opposite major face 3, extending from terminal portions of which, adjacent to the minor side faces 4, are dovetailed projections 5.

Once again in both cases, the brick 1A, 1B is formed with an array of internal through cavities 6, in the examples illustrated six in number, parallel and adjacent to the major face 2.

The substantial difference between the building element 1A and the building element 1*b* lies in their thickness, indicated, respectively, by S1 and S2 in FIGS. 2 and 4: the thickness S1 of the building element 1A is 125 mm, whilst the thickness S2 of the building element 1B is twice as much, i.e., 250 mm.

The building element 1A is formed with a pair of recesses or through cavities 7 that give out at the top and at the bottom, the function of which will be clarified in what follows.

The building element 1B has, instead, two pairs of recesses or cavities 7, as well as a pair of further through cavities 8 of a circular shape, the function of which will likewise be clarified in what follows.

Figure 5:
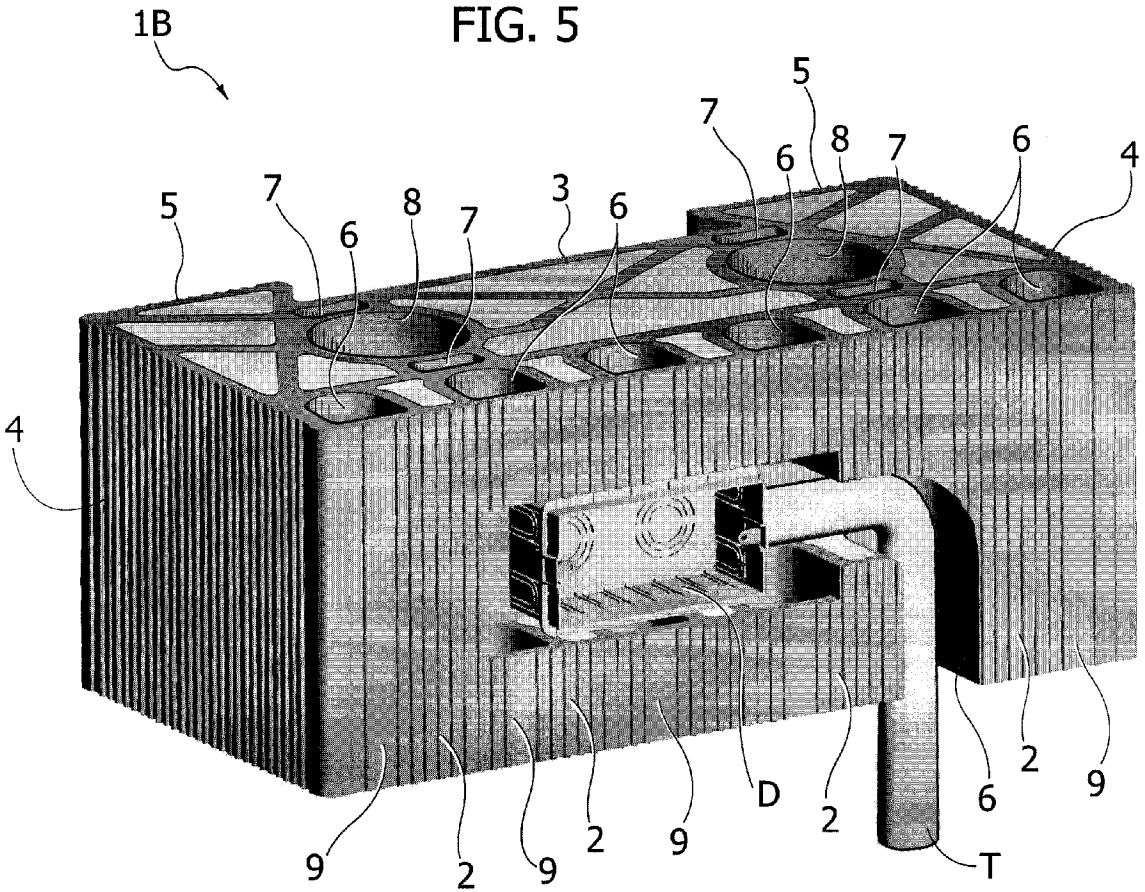
FIGS. 5 and 6 are views similar to that of FIG. 3 that show two different possibilities of application of the building element.

Both in the case of the building element 1A and in the case of the building element 1B, the external surfaces are ribbed, i.e., formed with vertical ribbings projecting outwards. According to the basic characteristic of the invention, the ribbings present on the major face 2 have interruptions 9 aligned axially each with a respective through cavity 6 and arranged in a corresponding position in front of these. The interruptions 9 constitute references for the immediate identification from the outside of the corresponding through cavities 6, which have the function of enabling, following upon laying of the building elements 1A and/or 1B for the formation of a masonry structure or the like, access to one or more of the cavities 6 for enabling application and housing of operative connections of distribution systems, and in particular wireways and/or pipes or ducts for electricity, water, gas, air-conditioning, etc. An example of such an application is represented in FIG. 5, with reference to the building element 1B: a pipe T is inserted through one of the cavities 6 after the latter has been partially split, i.e. exposed to the outside following breakage of the face 2 along the related interruption 9, to reach a box D for example of an electrical switch housed crosswise through two or more further cavities 6.

Figure 32:
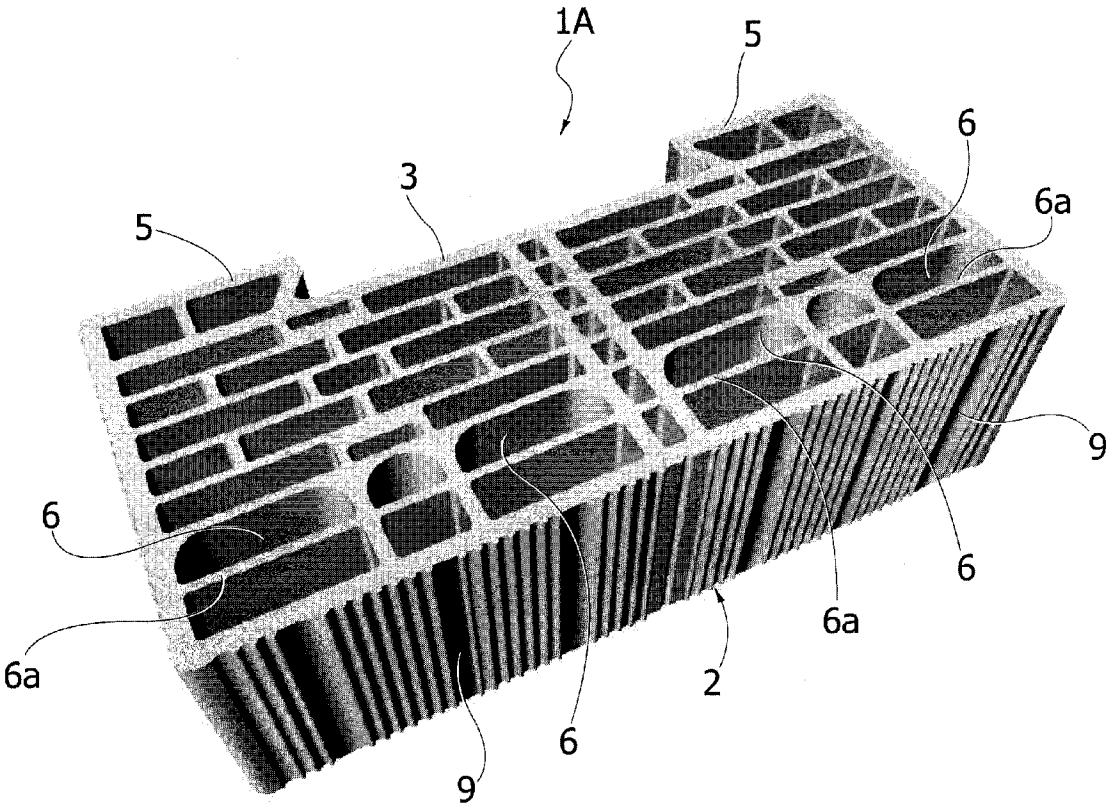
Figure 33:
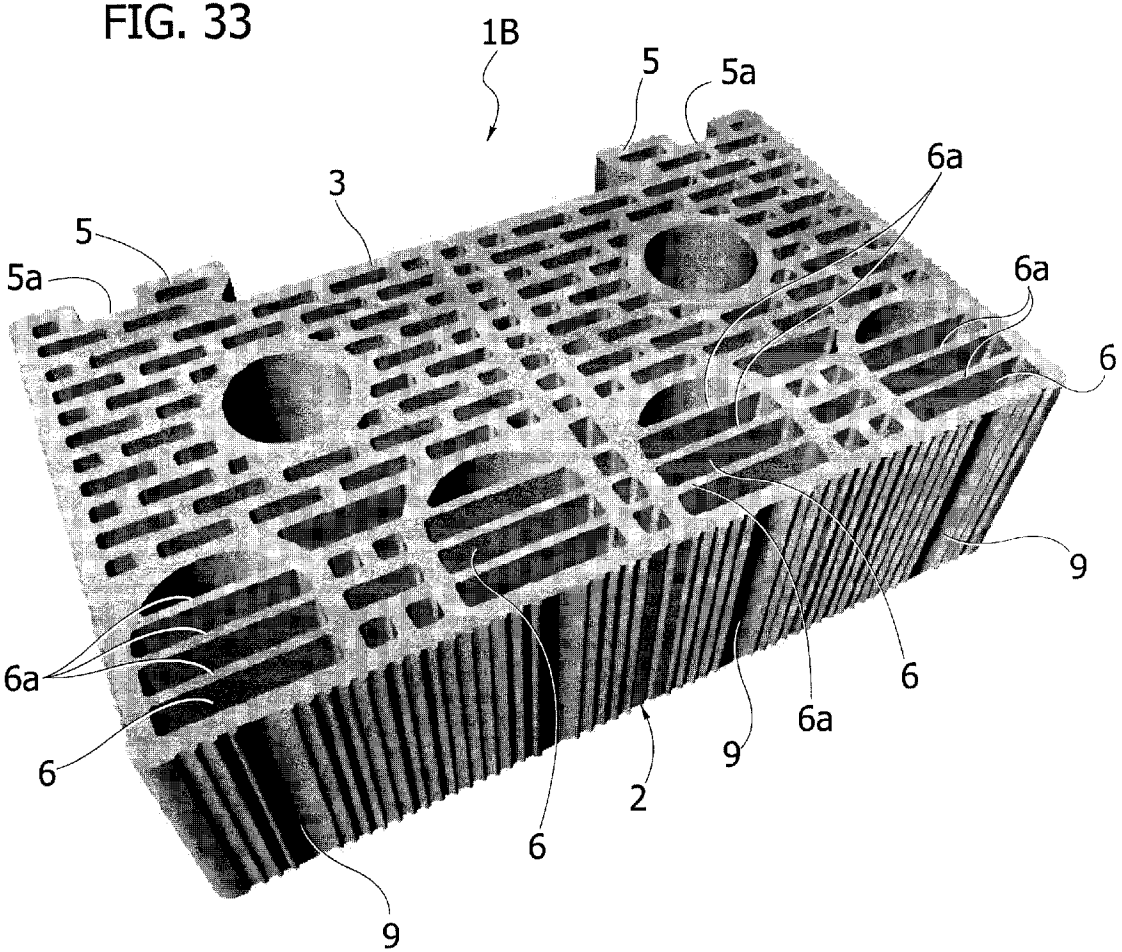

According to a further peculiar feature of the invention, each cavity 6 is formed with one or more inner frangible partition walls 6*a*, arranged parallelly to the plane of the major face 2, as shown in FIGS. 32 and 33. These frangible walls 6*a* are designed to be broken, if necessary, for housing of operative connections of distribution systems and the like to be inserted within the respective cavity 6.

Figure 6:
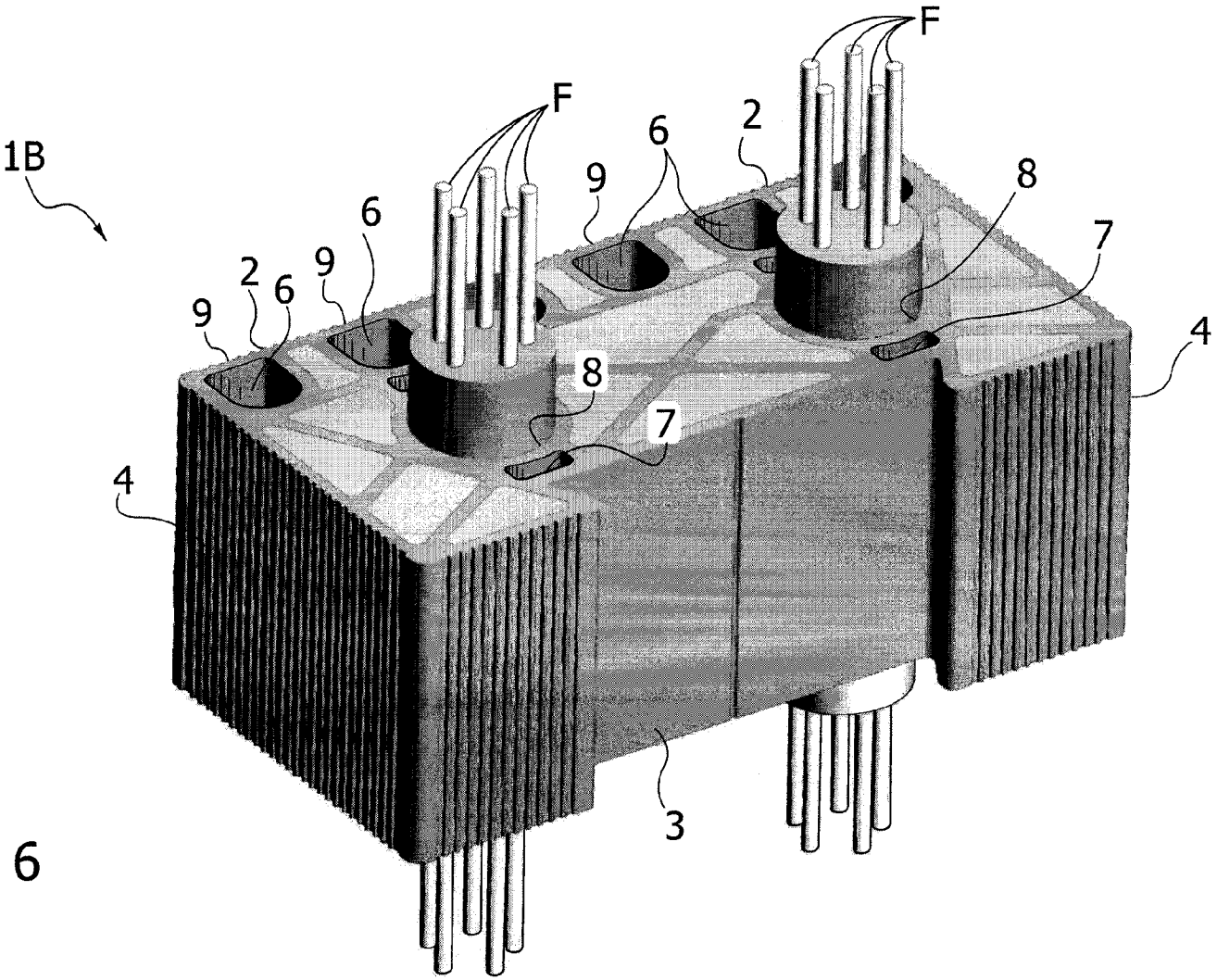

Once again with reference to the building element 1B, FIG. 6 exemplifies the use of the two through cavities 8: as may be seen, they can be used for the passage of reinforcement rods F that bestow antiseismic properties on the load-bearing masonry structures built with the use of said elements 1B.

The elements 1A and 1B are moreover formed with further lightening perforations, which can also be conveniently filled with a thermal and/or acoustic insulating material, such as for example pearlite. Typically, the elements 1A can present a real hole percentage (RHP) of 44.02% (Class 45), and the elements 1B can present a real hole percentage (RHP) which can range between 44.02% (Class 45), 54.90% (Class 55), and 61.42% (Class 60).

Figure 7:
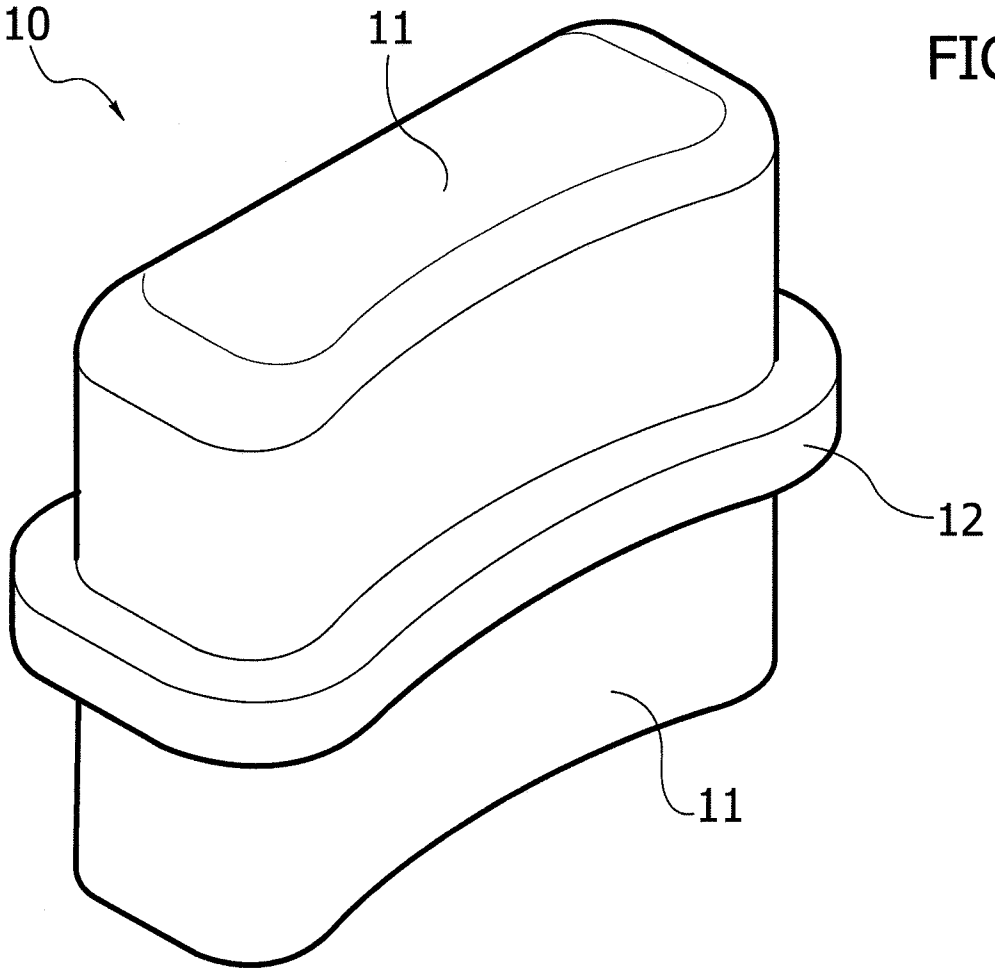
FIG. 7 is a schematic perspective view at an enlarged scale that shows one of the auxiliary members of the building system that uses the building elements of FIGS. 1, 2 and 3, 4.
Figure 8:
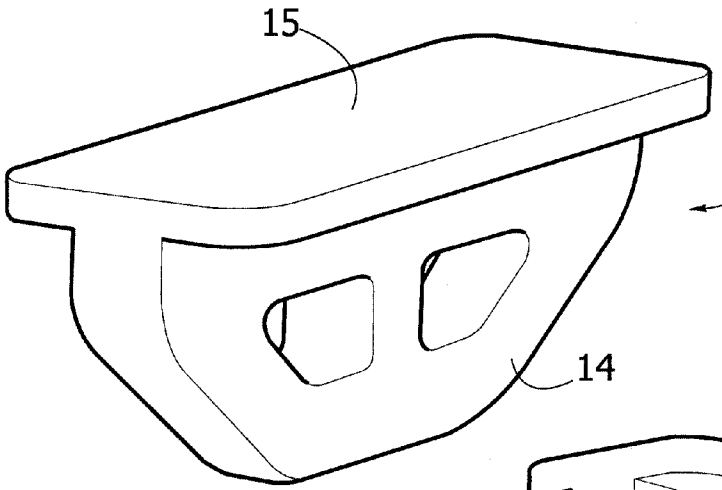
FIG. 8 is a schematic perspective view from above and at an enlarged scale of a second auxiliary member of the building system.
Figure 9:
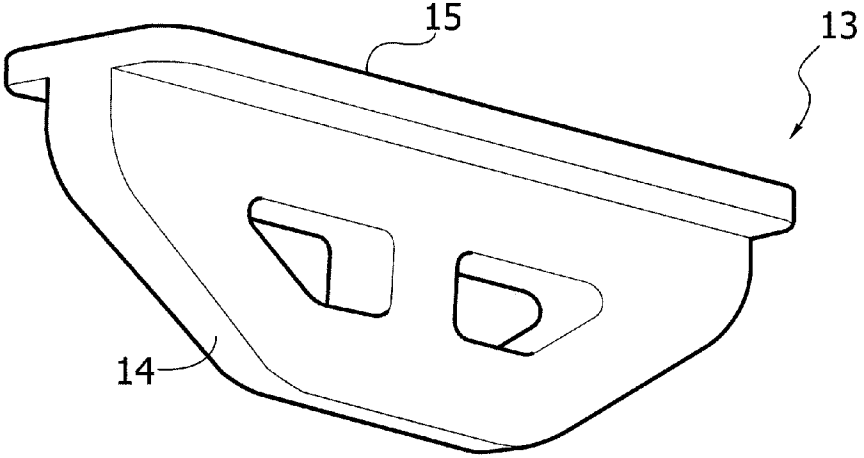
FIG. 9 is a perspective view from beneath of the second auxiliary member.
Figure 10:
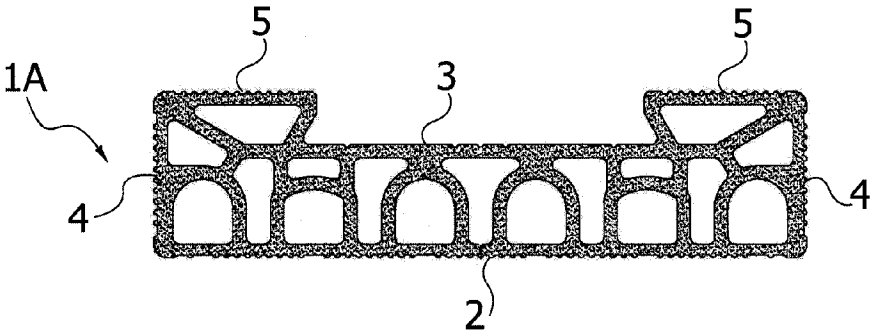
FIGS. 10-15 are views similar to that of FIG. 2 that exemplify the successive steps of laying of building elements according to FIGS. 1 and 2.
Figure 11:
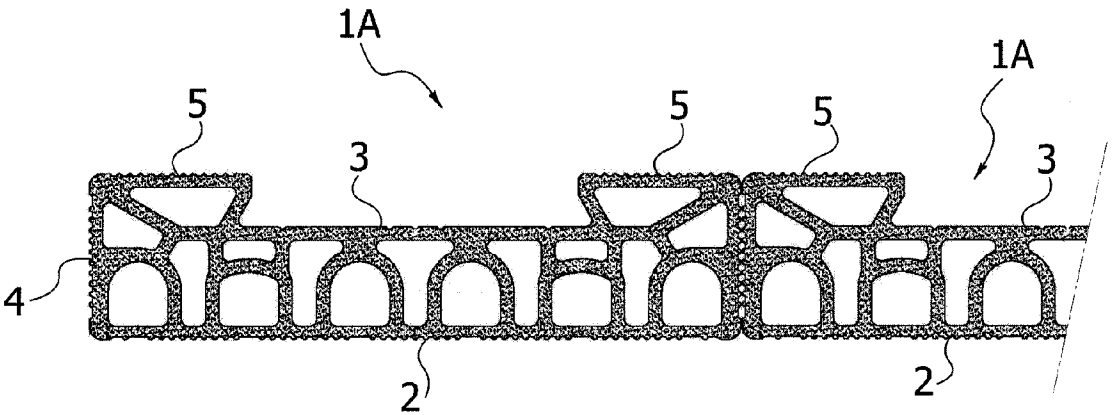

FIGS. 7 and 8, 9 illustrate, at a very enlarged scale with respect to the representations of the building elements 1A and 1B, two auxiliary members that concur, together with said building elements 1A and 1B, to constitute a modular building system.

The auxiliary member represented in FIG. 7 consists in a reference pin 10 that can be used, as will be seen, for vertical centring of building elements 1A or 1B set on top of one another. The reference pin 10 has two portions 11 of a shape complementary to that of the recesses or cavities 7, arranged symmetrically on opposite sides with respect to a perimetral flange 12. When a portion 11 is inserted within a recess or cavity 7, the peripheral flange 12 bears upon its outer edge.

The second auxiliary member represented in FIGS. 8 and 9 consists in a spacer 13 for the horizontal spacing between building elements 1A and/or 1B set side by side, or between rows of said elements 1A and/or 1B set side by side. The spacer 13 consists of a wedge-shaped diaphragm 14, which is designed to be positioned, as is will be seen in greater detail in what follows, between the side walls 4 of two adjacent building elements 1A or 1B and is surmounted by a transverse flange 15, designed to rest on top of said building elements 1A or 1B. This enables a precise and constant lateral spacing to be obtained.

The auxiliary members 10 and 13 can be made with recycled plastic materials, chipboard, or any other material having low environmental impact and presenting adequate mechanical characteristics.

With reference now to FIGS. 10 to 16 and 17 to 20, there will now be described examples of laying of building elements 1A and building elements 1B, respectively, for the construction of a wall structure. In both cases, the laying of the horizontal rows of the elements 1A, 1B is very simplified thanks to their conformation described previously. In particular, slotting together of the bricks by means of the dovetailed projections 5 guarantees their perfect horizontal alignment together with the maximum simplicity and rapidity of laying, as well as a high structural stiffness that ensures, during laying, a structure that is self-bearing to be obtained. It should, however, be noted that, in the case where it were to prove necessary for particular constructional needs, the slotted fitting between the elements 1A and/or 1B is not necessary, since it is in any case possible to guarantee the correct values of mutual distance and alignment using the spacer 13 of FIGS. 8 and 9.

The constancy in the distance between the elements 1A and/or 1B favours uniform and constant spreading of the mortar or similar binder subsequently applied to said elements both in the horizontal plane and in the vertical plane.

Figure 12:
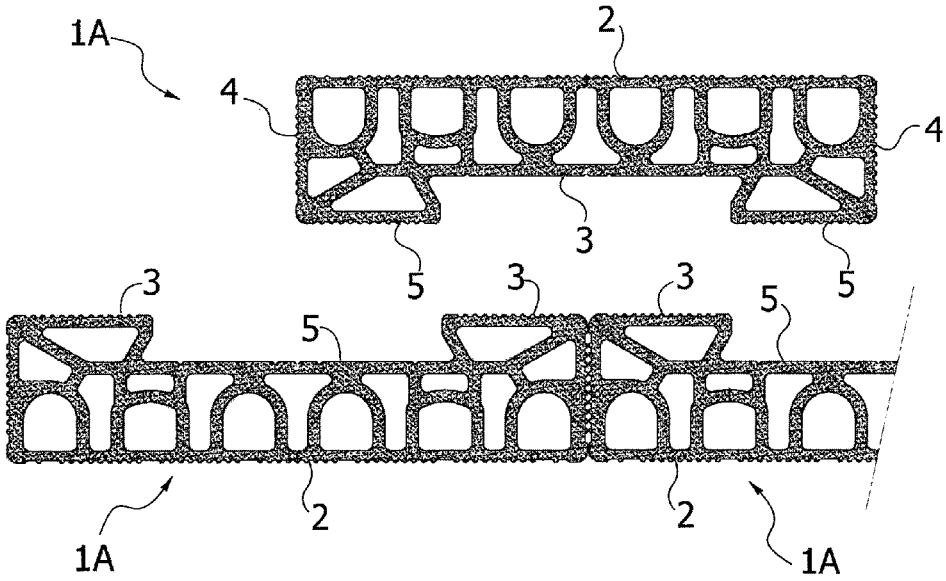
Figure 13:
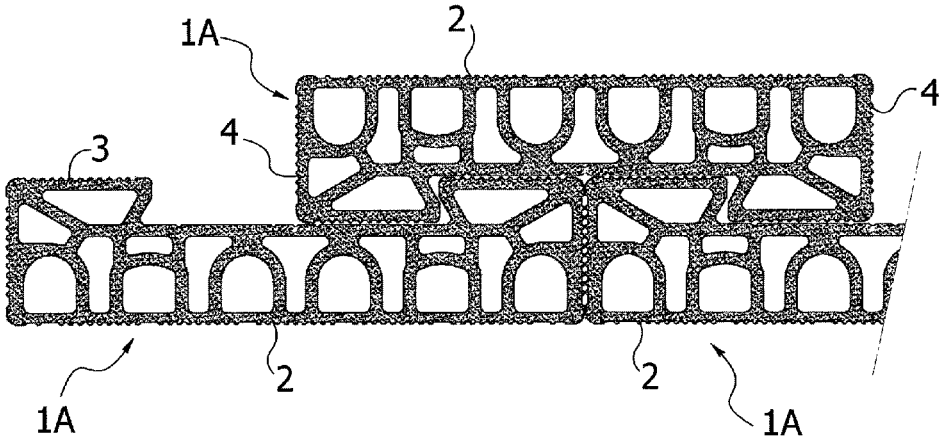
Figure 14:
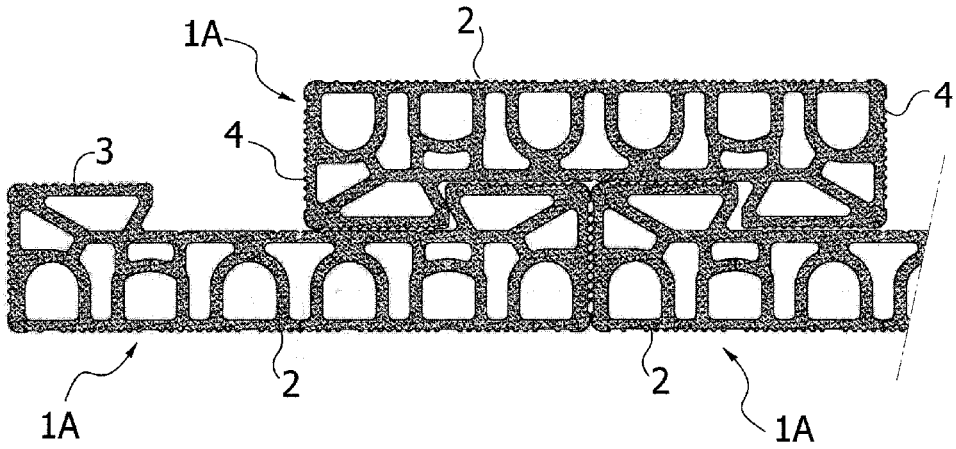
Figure 15:
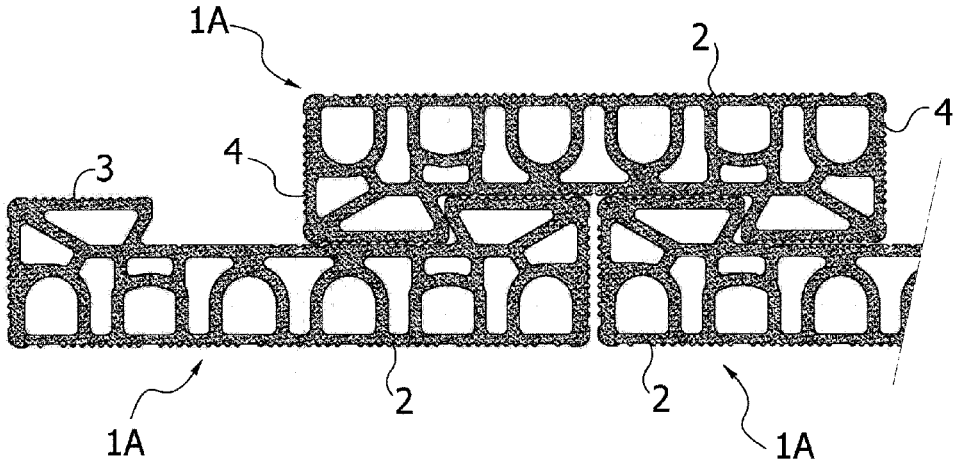
Figure 16:
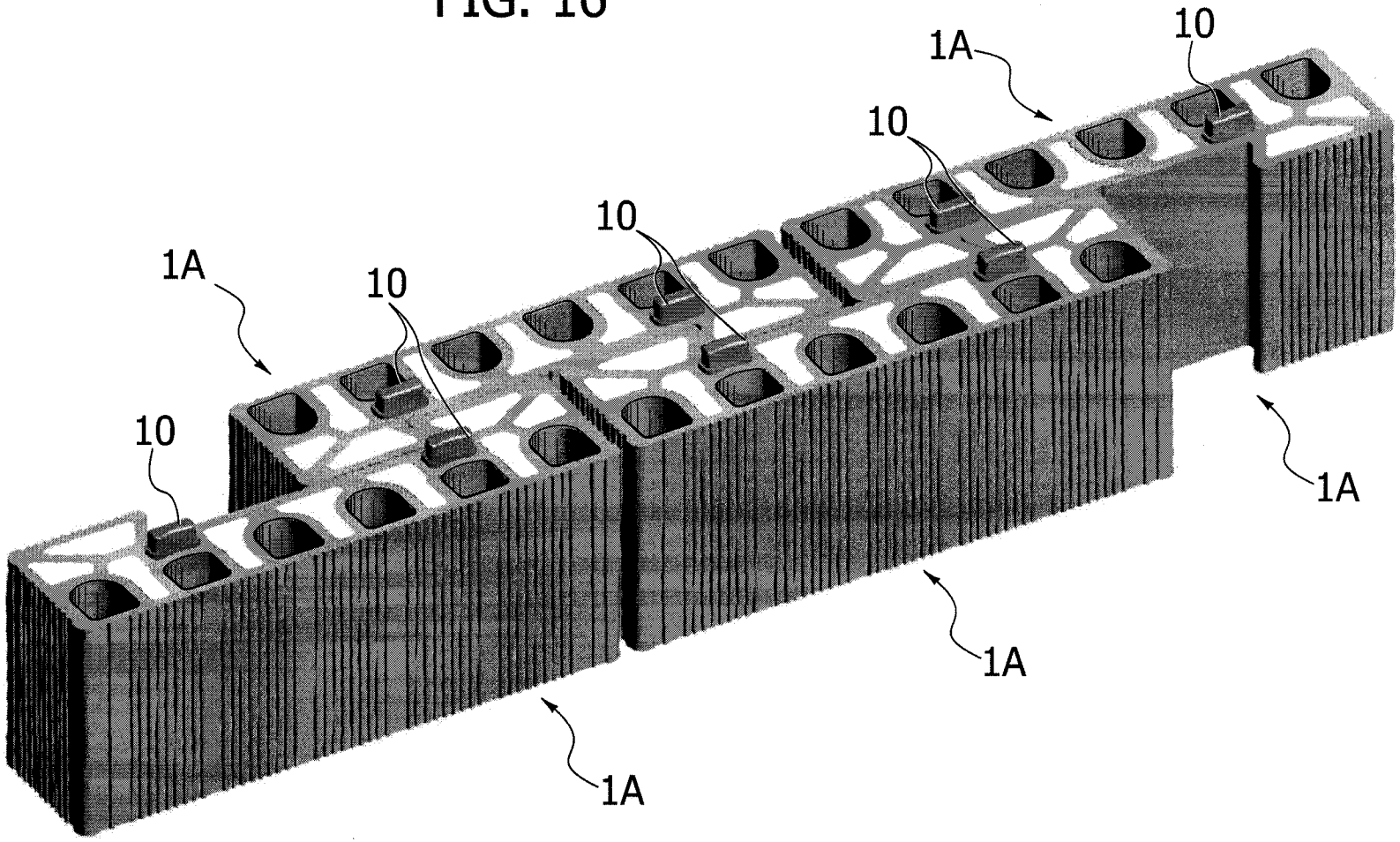
FIG. 16 is a perspective view that shows building elements according to FIGS. 1 and 2 during a step of laying.
Figure 17:
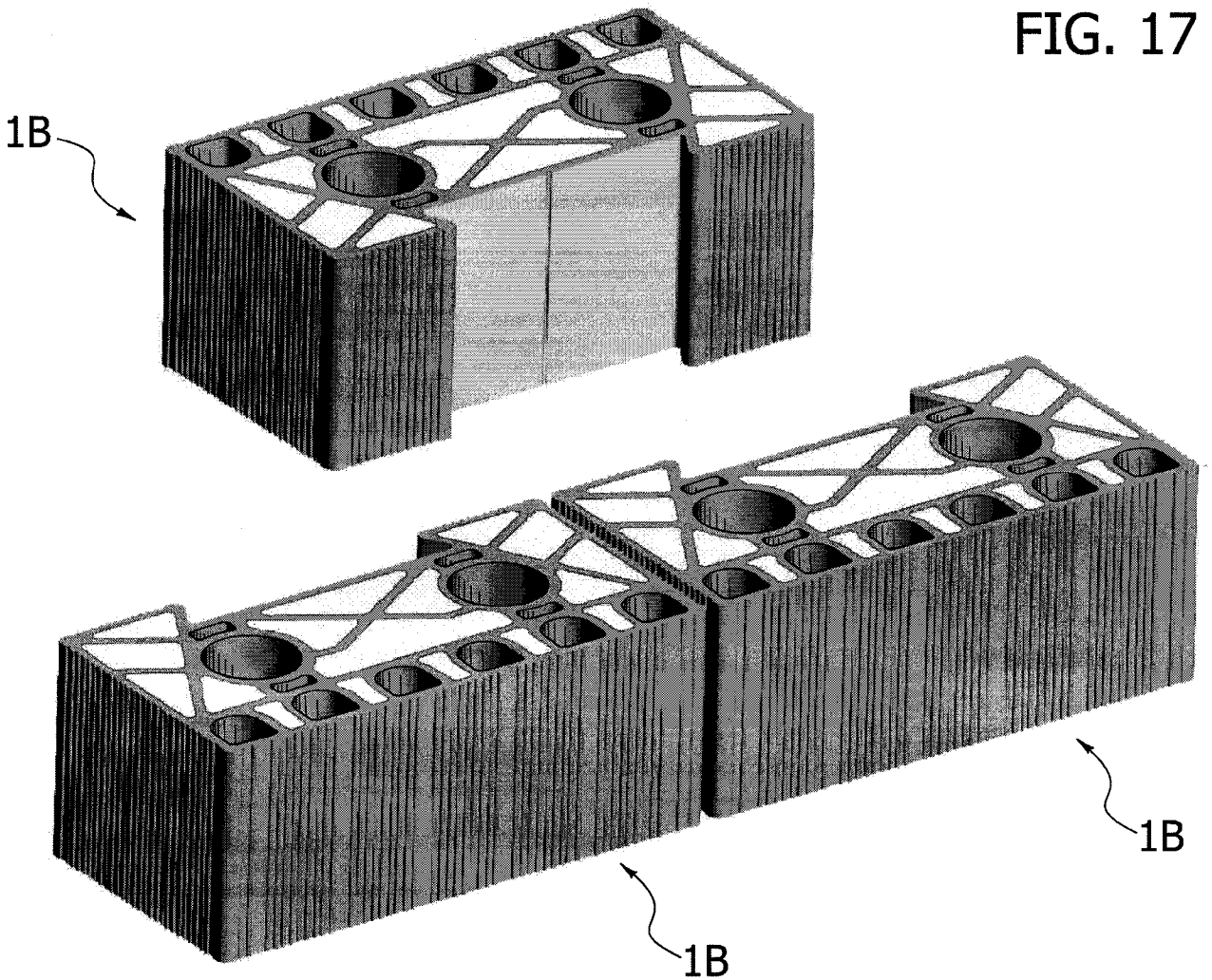
FIGS. 17-20 are perspective views that exemplify the successive steps of laying of building elements according to FIGS. 3 and 4.

With reference now in particular to FIGS. 10 to 16, the methodology of laying of a horizontal row of building elements 1A envisages, after positioning of the first element (FIG. 10), positioning of a second element set alongside the first with the corresponding side walls 4 (FIG. 11) set up against one another, and then laying of a third element in front of the first two (FIG. 12). The third element is then inserted at the front until it comes into contact with the first two, the adjacent dovetailed projections 5 of which are inserted between the dovetailed projections 5 of the third element (FIG. 13). The third element is then slotted into place with respect to the first by means of a translation in the direction of the second (FIG. 14), and then the first and the second elements are separated from one another in such a way as to engage the corresponding dovetailed projections 5 with the dovetailed projections 5 of the third element (FIG. 15). The procedure for a fourth element is similar (FIG. 16), and so forth up to completion of a horizontal row. In the spaces each time formed between the side walls 4 of contiguous elements the spacer elements 13 can be inserted, and the centring pins 10 are inserted in the recesses 7, in the way also illustrated in FIG. 16. In this way, the next row of elements 1A obtained with the same methodology, by superimposing further elements 1A on the underlying ones, is perfectly centred and aligned so as to guarantee the complete absence of any discontinuity.

Figure 18:
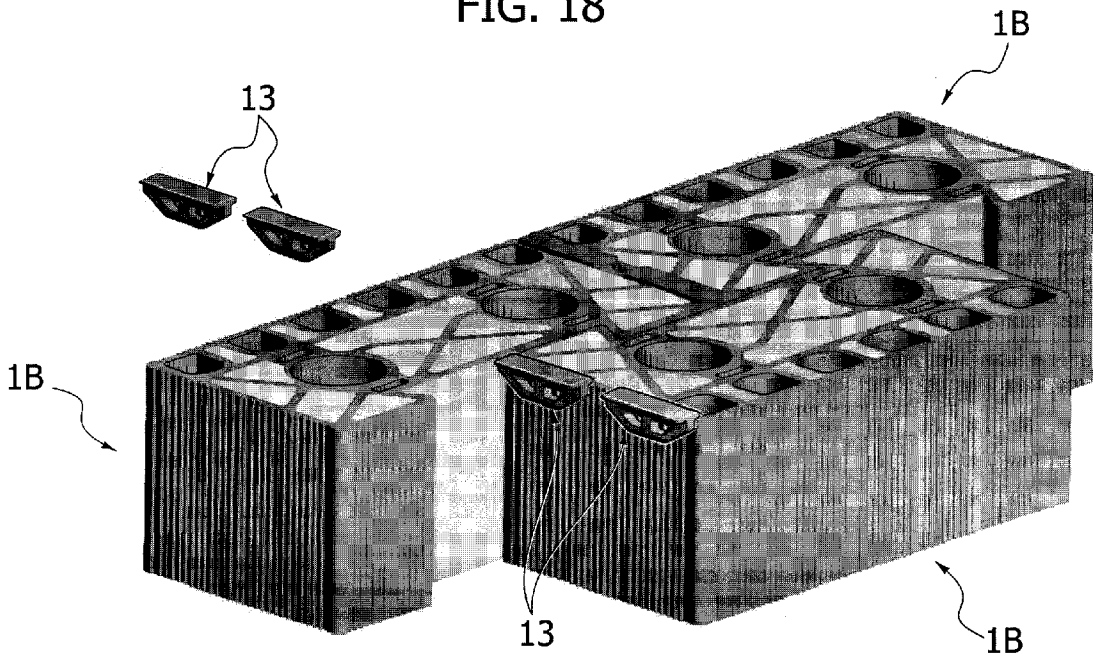
Figure 19:
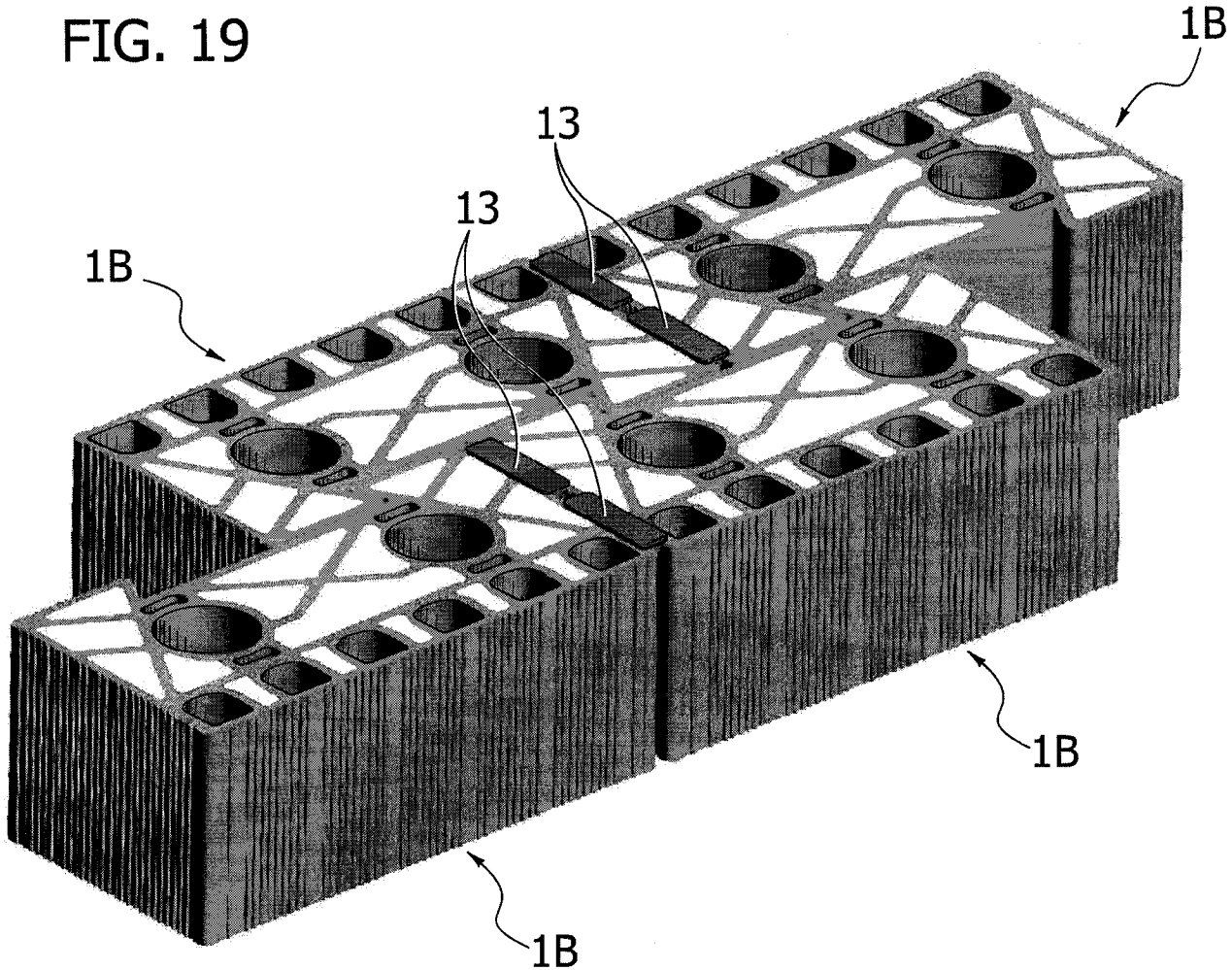
Figure 20:
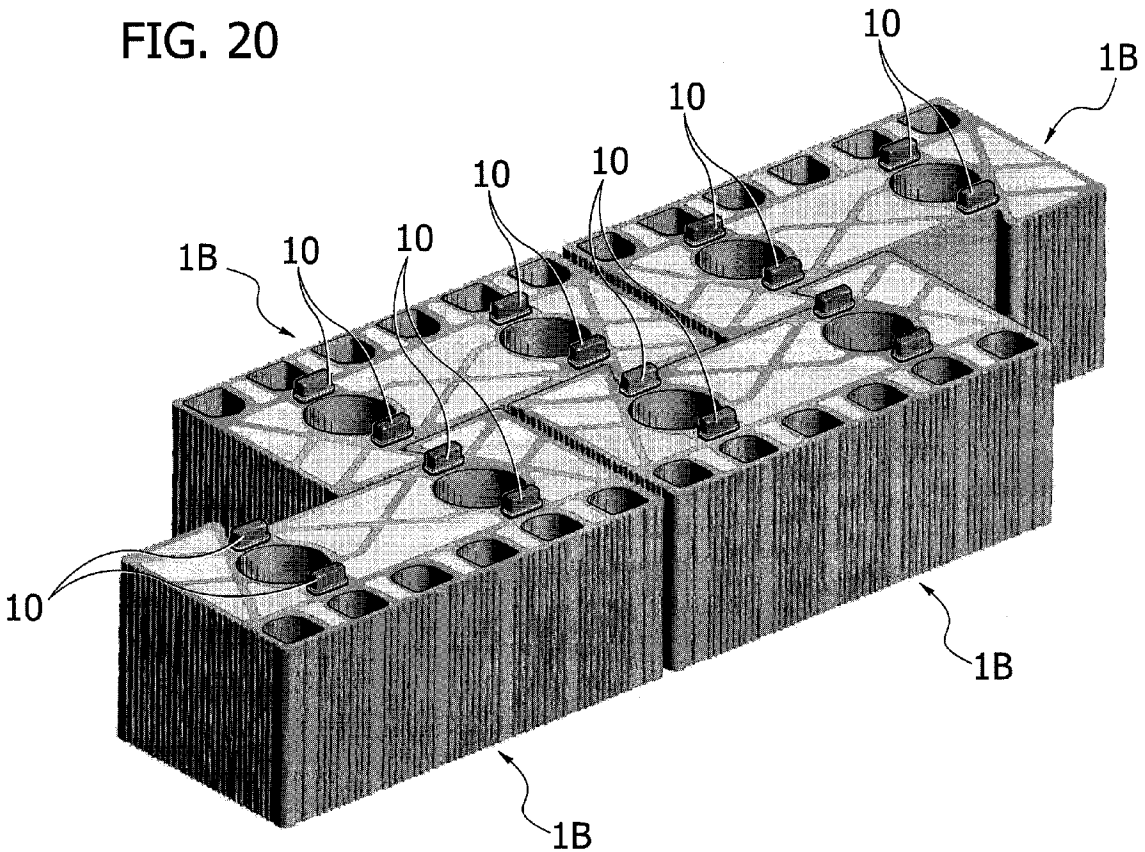

The process of laying of the elements 1B, represented in FIGS. 17 to 20, is altogether similar: in particular, the positioning of the horizontal spacer elements 13 is represented in FIG. 18, and that of the vertical centring elements 10 is illustrated in FIG. 20.

Figure 21:
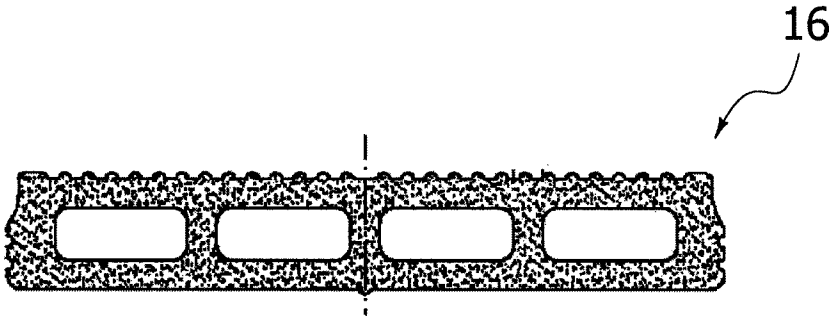
FIGS. 21 and 22 are horizontal cross-sectional views of two different accessory members of the building system according to the invention.
Figure 22:
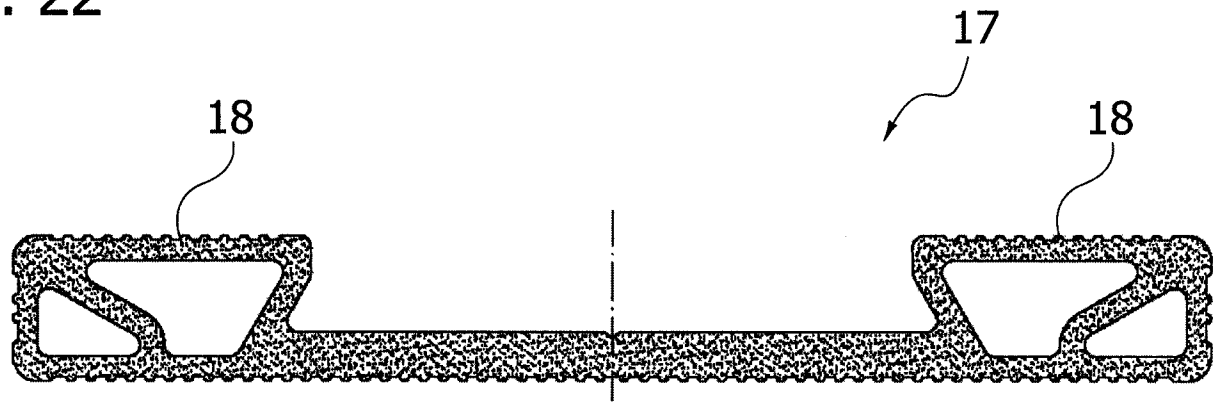
Figure 35:
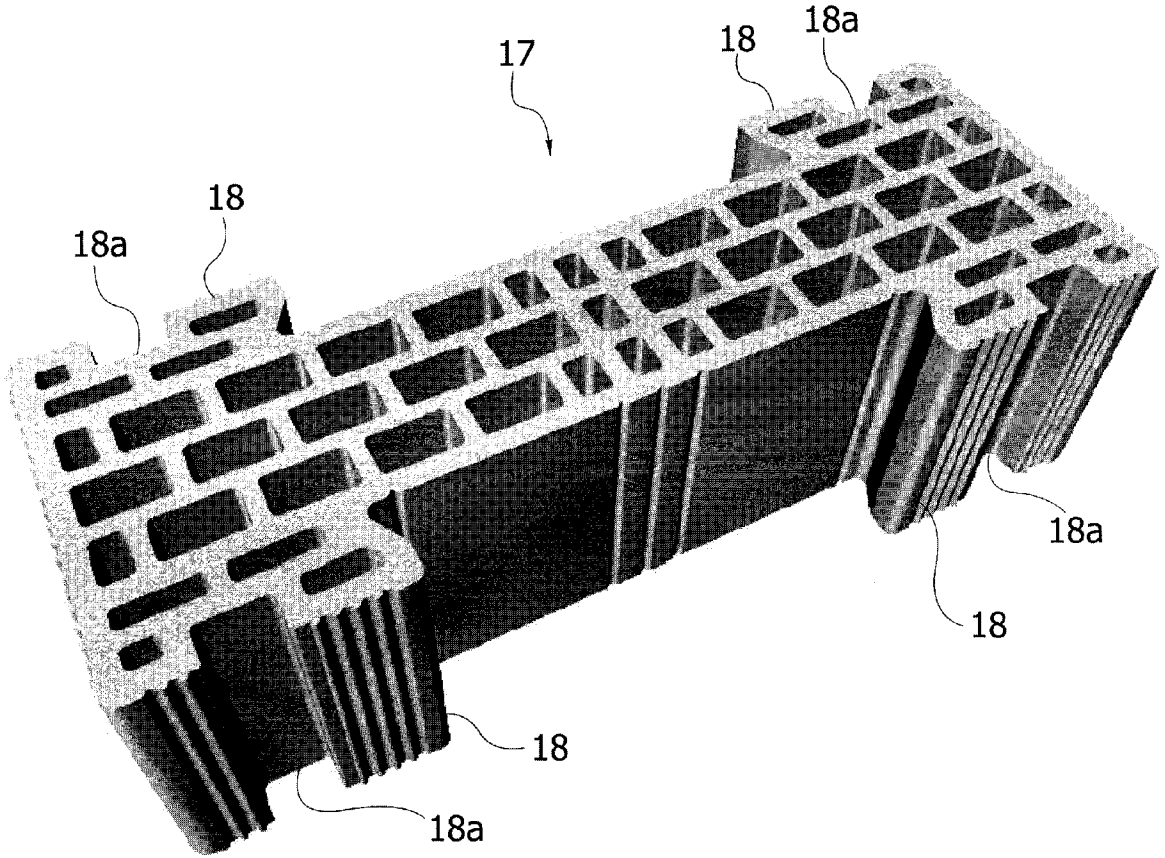
FIG. 35 is a schematic perspective view of a further accessory member of the building system according to the invention.

Of course, the elements 1A and the elements 1B can be variously combined with one another so as to provide structures of different thicknesses. For this purpose, the building system according to the invention moreover envisages two accessory members, designated by 16 and 17 in FIGS. 21 and 22, respectively, which can possibly be used as elements for closing the recesses comprised between the dovetailed projections 5 of the elements 1A or else 1B in the case where the corresponding horizontal rows include single elements. The accessory member 16 has a length substantially equal to that of said recess, whilst the accessory member 17 has a length corresponding to that of the elements 1A or 1B and is itself provided with dovetailed projections 18, even on opposite sides thereof as shown in FIG. 35.

FIGS. 23 to 31 show the different possibilities of combination between the different components of the building system described above for providing wall structures of different thicknesses, typically comprised between a minimum of 60 mm and a maximum of 460 mm.

Figure 23:
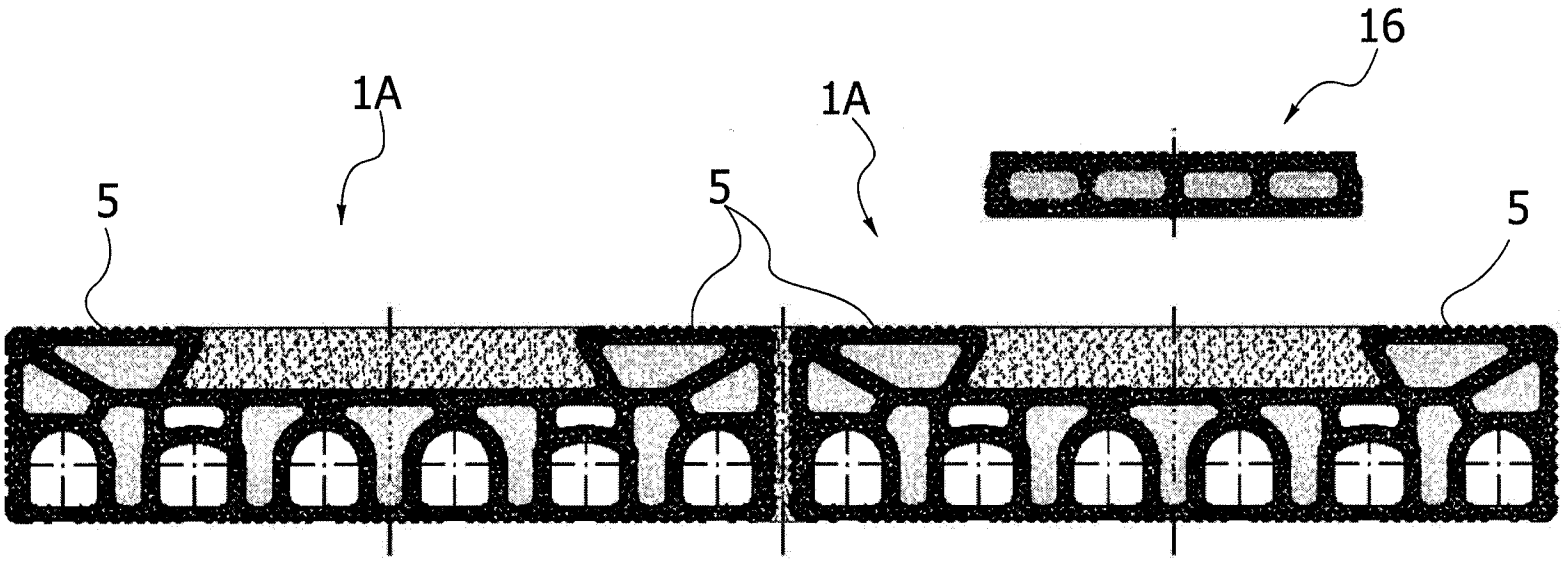
FIGS. 23-31 are horizontal cross-sectional views that show the different possibilities of composition of the building elements according to FIGS. 1, 2 and/or FIGS. 3, 4, also with the aid of the accessory members according to FIGS. 21 and 22, FIGS. 32, 33 and 34 are schematic perspective views of a building element according to respective additional embodiments of the invention.
Figure 24:
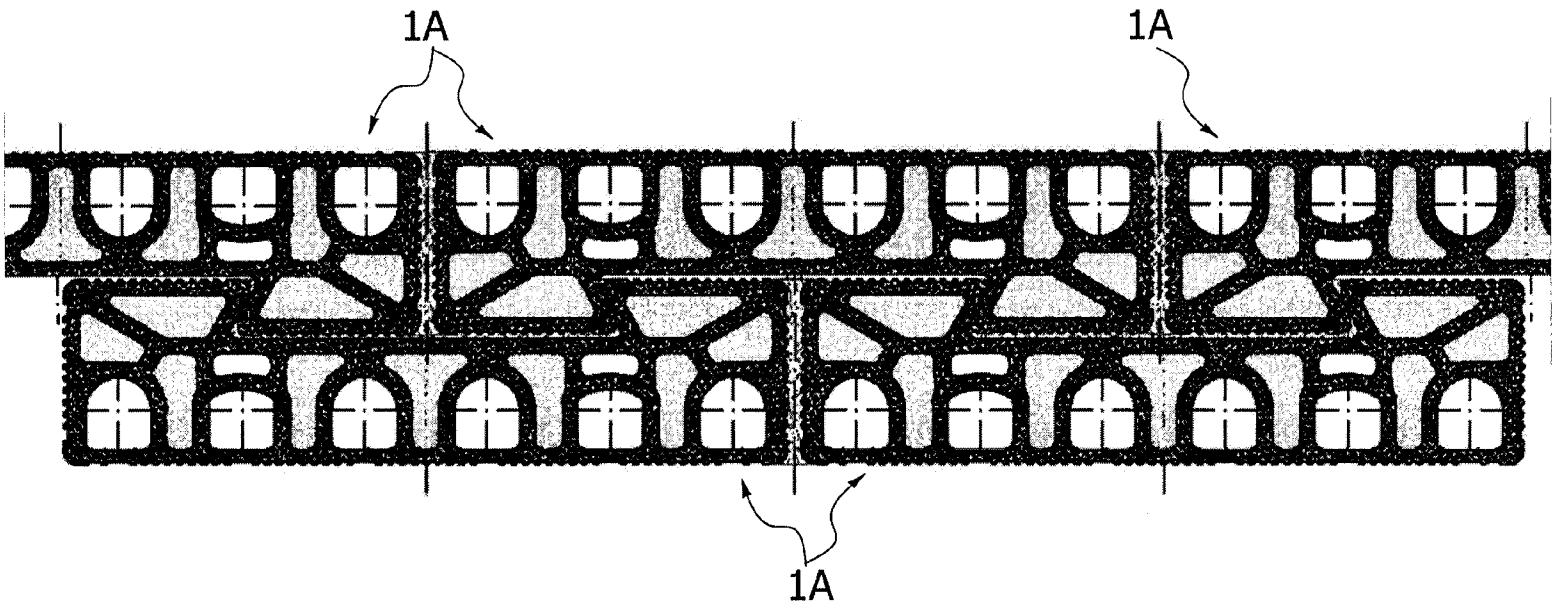
Figure 25:
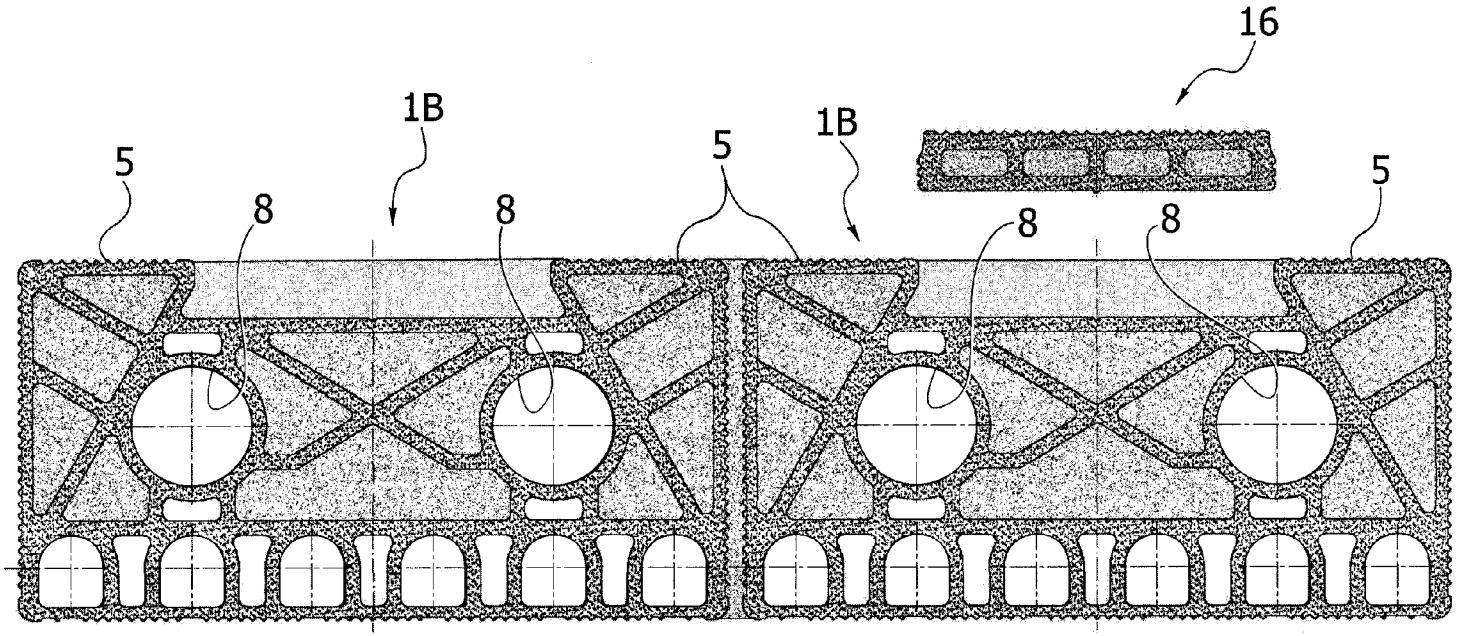
Figure 26:
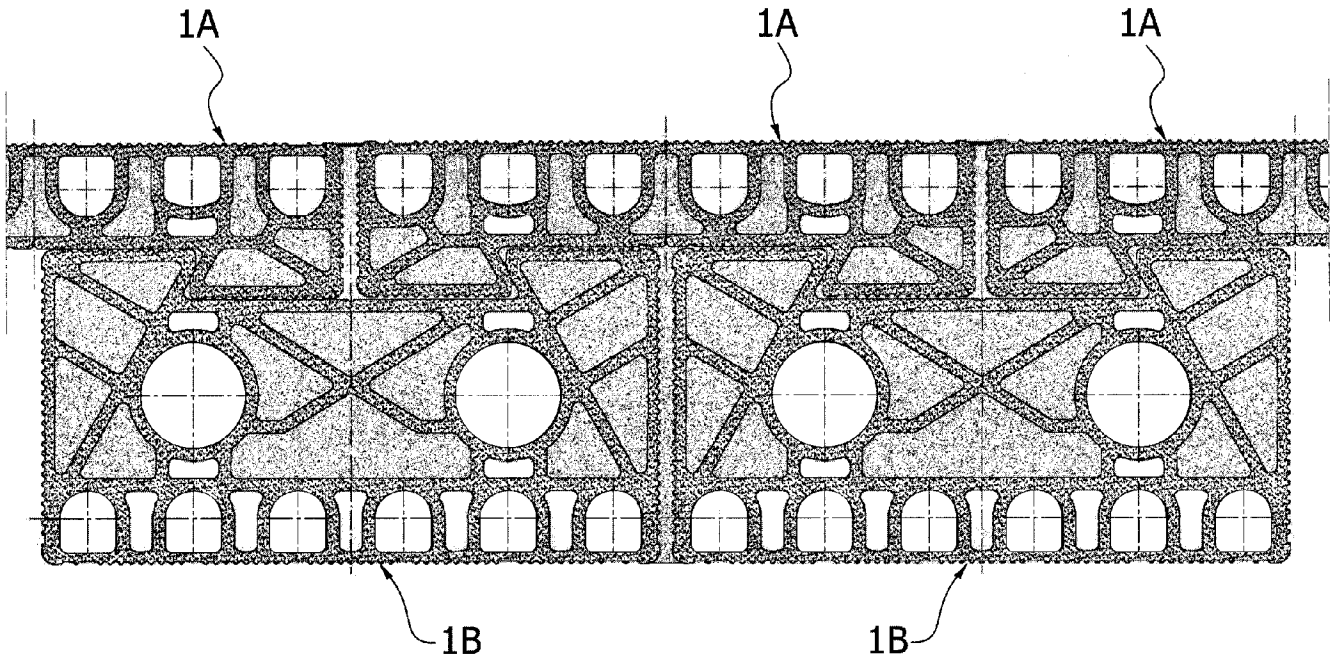
Figure 27:
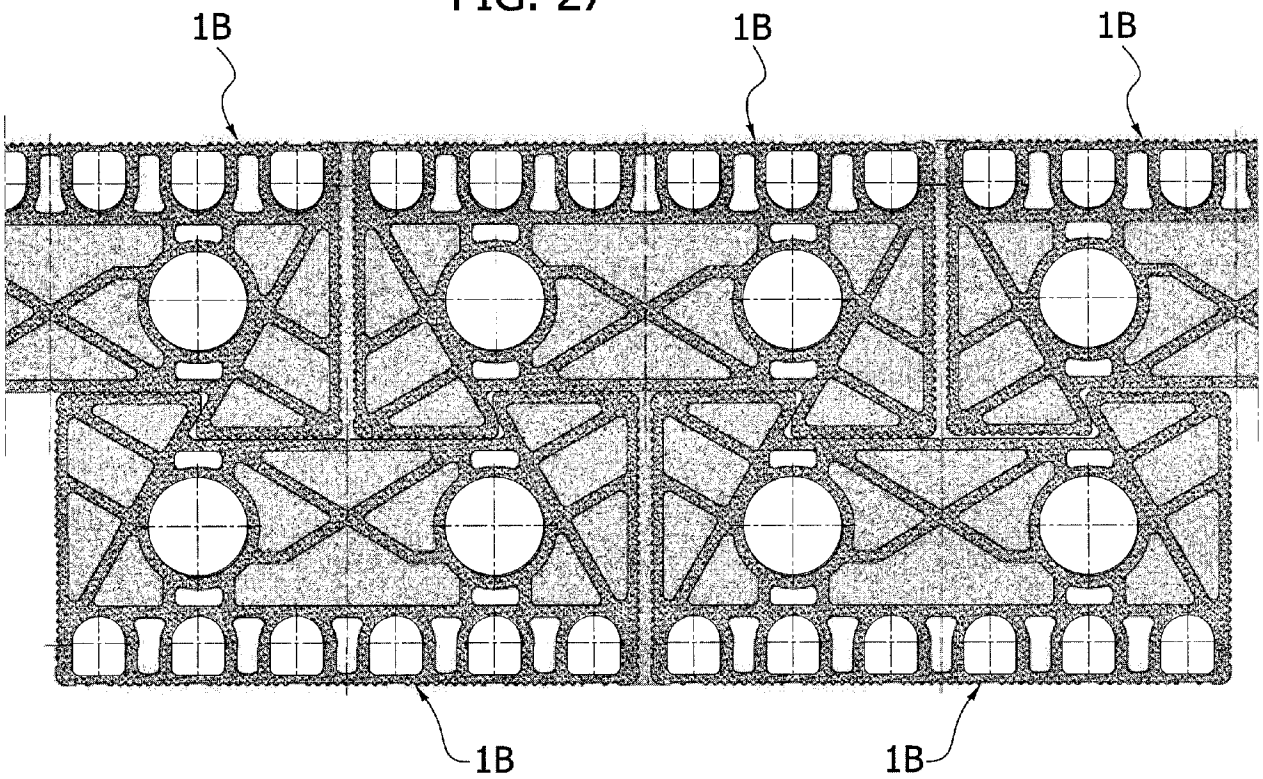

In particular:

FIG. 23 represents the thickness of 125 mm, obtained with the use of single rows of elements 1A, the recesses of which, delimited by the corresponding dovetailed projections 5, can be filled with mortar or similar binder, or else alternatively with the accessory members 16; it should be noted that in this case, as in all the other cases that will be described in what follows, all the cavities of the elements may be filled, as already clarified previously, with an insulating material, except for the cavities 6 that are to be used for possible insertion of pipes, ducts or wireways; the mortar is then inserted within the compartments defined between the side walls 4 of the elements 1A;

FIG. 24 shows the thickness of 210 mm, deriving from the use of two rows of elements 1A slotted together in the way clarified previously;

FIG. 25 shows the thickness of 250 mm deriving from single rows of elements 1B; also in this case, the compartments comprised between the corresponding dovetailed projections 5 can be filled with a mortar or else closed with the auxiliary members 16; the pairs of through cavities 8 remain empty to enable the possible insertion of reinforcement elements;

FIG. 26 shows the thickness of 335 mm, deriving from the coupling of a row of elements 1A and of a row of elements 1B; and FIG. 27 shows the maximum thickness of 460 mm, deriving from the use of two coupled rows of elements 1B.

Figure 28:
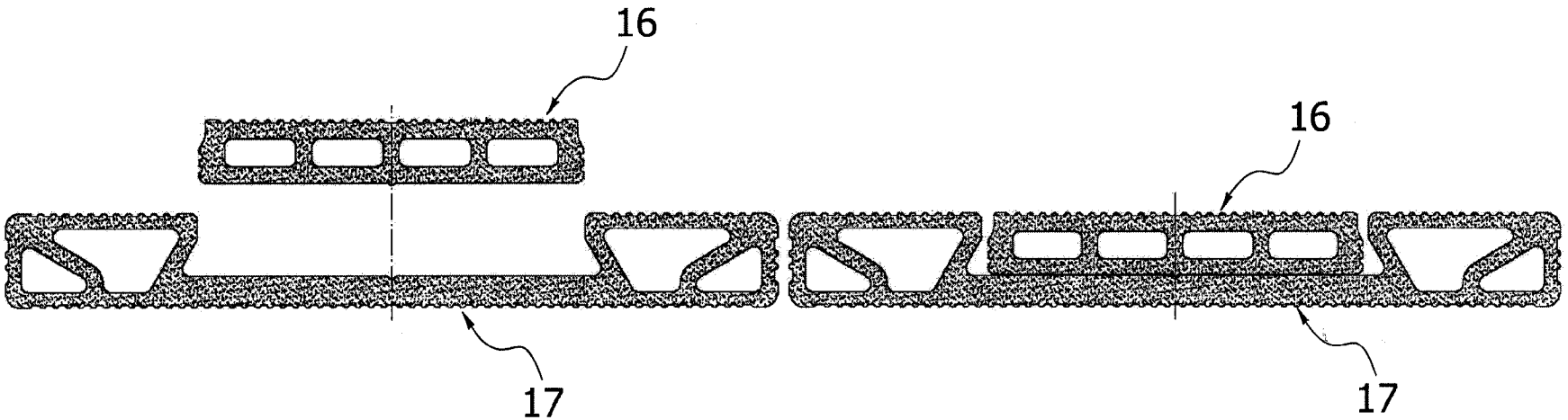
Figure 29:
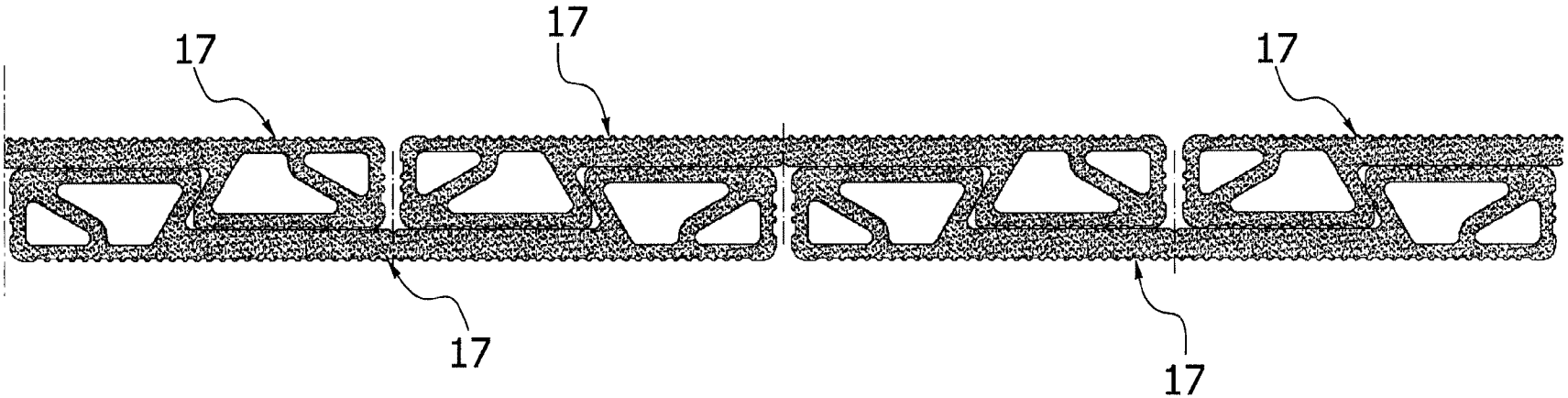
Figure 30:
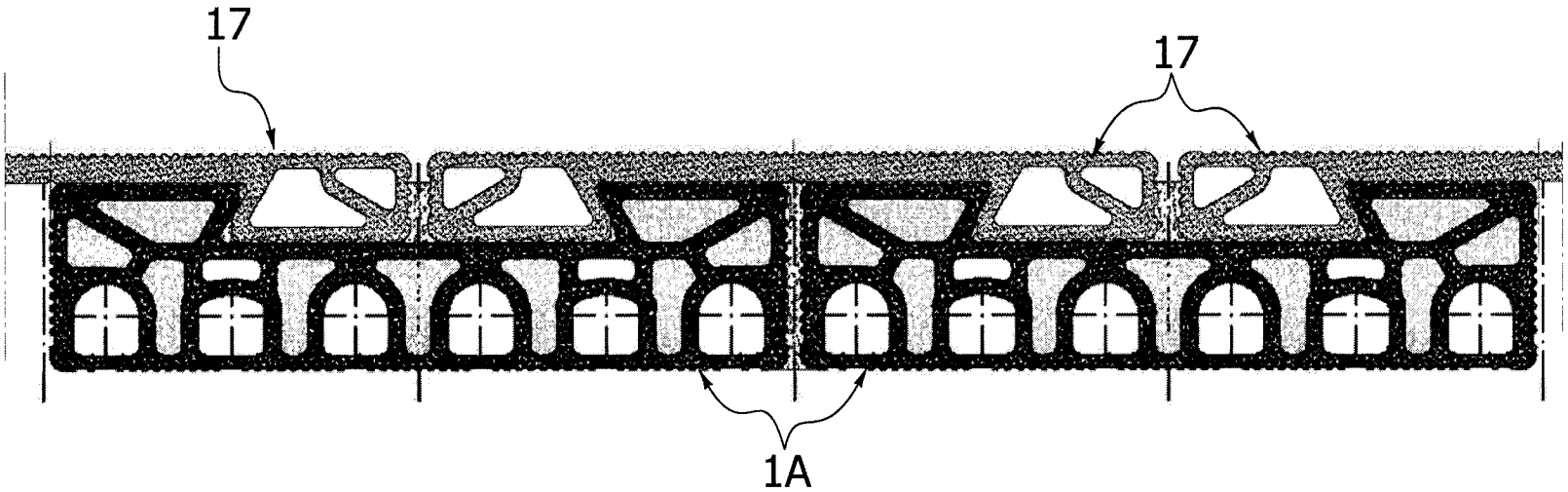
Figure 31:
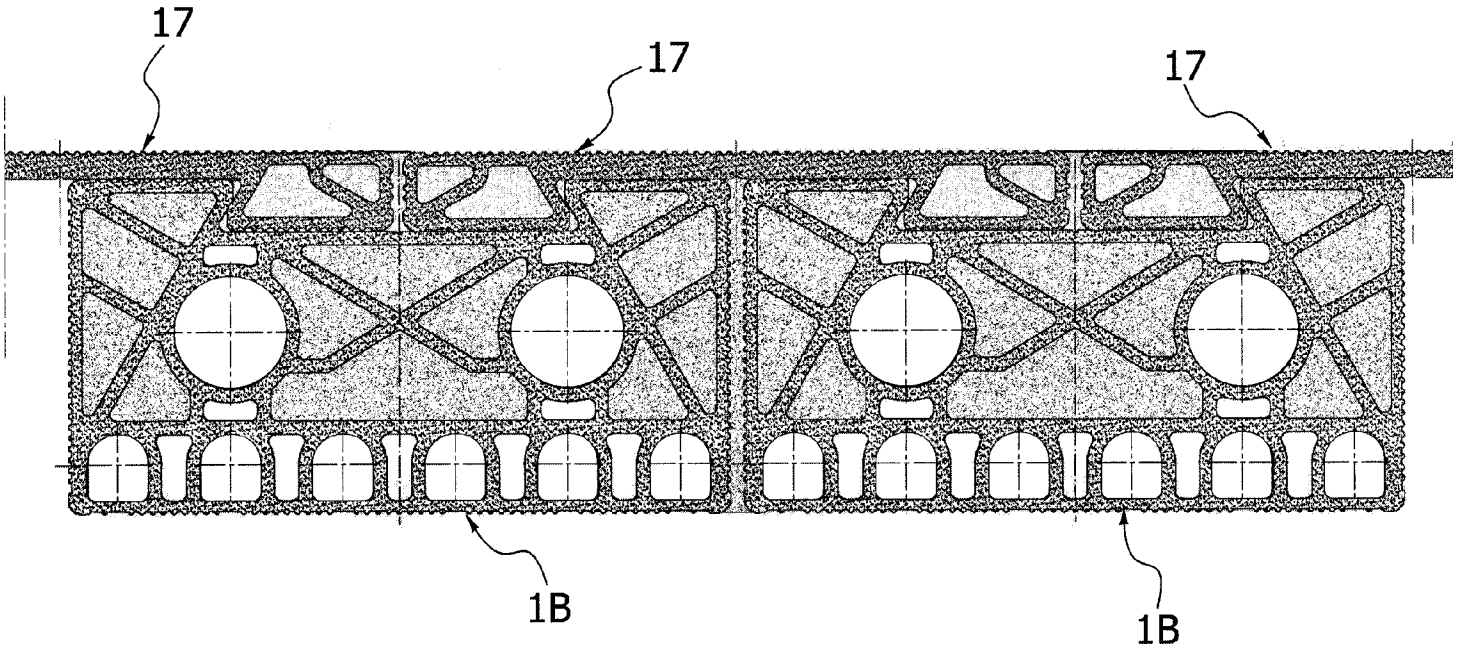

Further different thicknesses may be obtained by means of other combinations between the accessory members 16 and 17 and between these and the elements 1A or 1B, and in particular:

FIG. 28 shows the minimum thickness of 60 mm deriving from a row of closing members 16 and 17 coupled together;

FIG. 29 shows the thickness of 80 mm deriving from a row of closing members 17 slotted together;

FIG. 30 shows the thickness of 145 mm deriving from a row of elements 1A slotted together with a row of closing members 17; and FIG. 31 shows the thickness of 270 mm deriving from a row of elements 1B slotted together with a row of closing members 17.

In all the above cases, with the sole exception of the smaller thicknesses of FIGS. 28 and 29, the structure laid is prearranged, as has been said, for receiving wireways and/or pipes and ducts so as to enable ease of installation of electrical wiring systems, plumbing, gas and air-conditioning systems, etc., through the through cavities 6. As already clarified previously, thanks to the interruptions of the ribbings 9, the cavities 6 are immediately identifiable from outside, thus enabling brick-layers, electricians, plumbers, etc. to work easily and conveniently also with the wall completely laid in place, reducing to a minimum the interventions of demolition.

Figure 34:
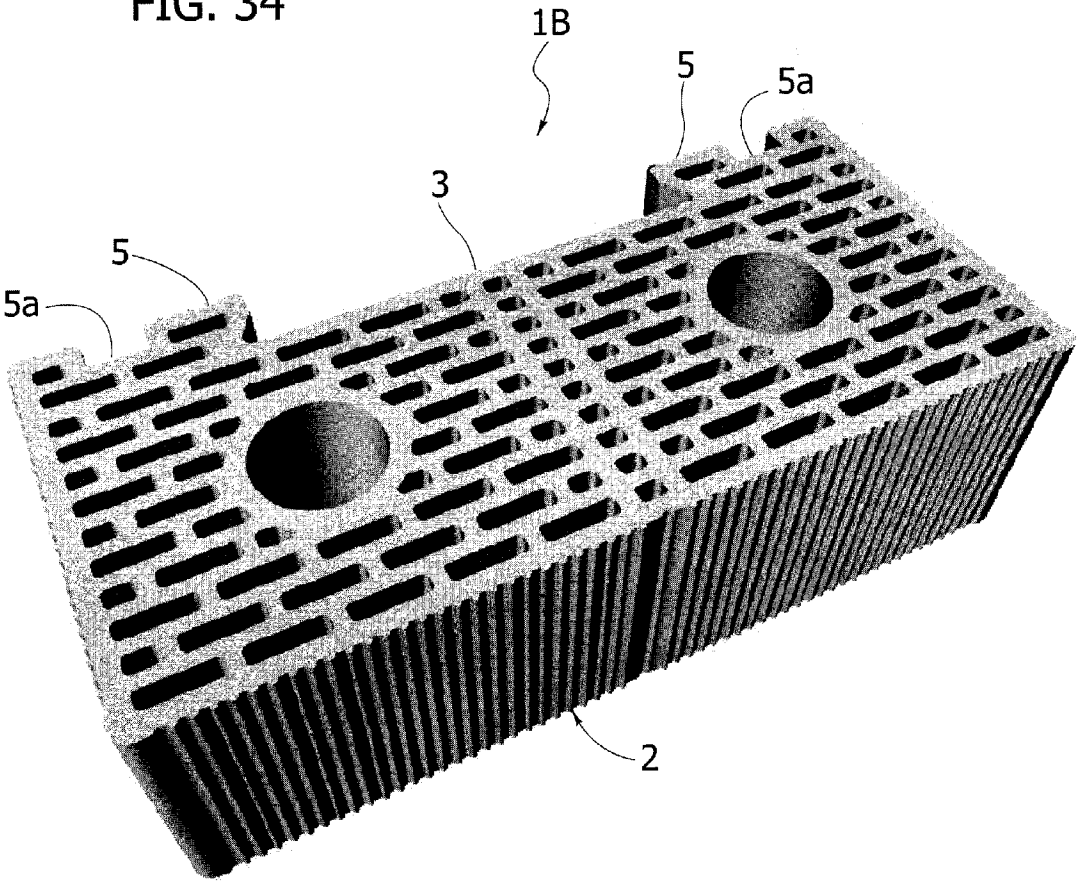

According to an additional peculiar feature of the invention, as shown in FIGS. 33 and 34 each dovetail projection 5 can be formed with a generally central vertical recess 5*a* defining, following upon laying of the building elements 1A and/or 1B for the formation of a masonry structure or the like, closed cavities to be filled with concrete or a like binding material. It is to be pointed out that such recesses 5*a* may be provided even in the case building elements 1A and/or 1B are not provided either with cavities 6, as shown in FIG. 34, or with cavities 8.

Similar recesses 18*a* for the same purpose can also be envisaged along the dovetailed projections 18 of accessory member 17, as shown in FIG. 35. Additionally, and as also shown in FIG. 35, accessory member 17 can be provided with dovetailed projections 18 on both major faces thereof.

It will emerge clearly from the foregoing description that all the components of the building system according to the invention can be manufactured in a simple and inexpensive way and are moreover studied and developed taking into account both the aspects regarding structural sturdiness in terms of capacity to withstand loads and also their manageability and lightness. The hollow structure of the various elements enables a reduction in weight of approximately 30% to be obtained as compared to conventional bricks given the same resistance to vertical loads, which also enables use thereof for the construction of load-bearing walls even without reinforcements, or else equipped with reinforcement elements that bestow on them effective antiseismic characteristics.

In addition, the conformation of the two basic elements 1A and 1B enables not only straight wall structures to be obtained but also angular, cross-shaped and T-shaped, curtain or partition, either internal or external, wall structures.

Further advantages of the building elements and of the building system according to the invention are summarized hereinafter:

logistics: the use of the just two basic elements 1A and 1B drastically simplifies the management of production, storage, and provisioning;

sturdiness: the structure of the basic elements 1A and 1B bestows upon them the maximum flexural and torsional resistance, minimizing localized stresses;

ergonomics: the perforations of the basic elements 1A and 1B enable them to be rendered extremely light, without altering the structural sturdiness thereof so as to guarantee for the operators when laying the maximum manageability with the minimum effort;

energy: the filling of the perforations of the basic elements 1A and 1B that are not to be used for passing pipes, ducts, wireways, reinforcement elements, etc. enables appreciable benefits to be obtained in terms of energy saving as well as sound-proofing; and ease of laying: the dovetailed projections for slot fitting, together with the vertical centring elements and the horizontal spacer elements, render composition of the basic elements 1A and/or 1B extremely simple and fast.

Of course, the details of implementation and the embodiments may vary widely with respect to what is described and illustrated herein, without thereby departing from the scope of the present invention as defined in the ensuing claims.

The invention claimed is:

1. A building element in the form of hollow brick comprising:

a structure formed of a frangible material, said structure comprising:

a plane major face and dovetailed projections on an opposite major face for slotting together with similar building elements for the construction of masonry structures, internal through cavities for housing of operative connections of distribution systems; and said through cavities arranged according to an array parallel to said plane major face and in that said plane major face is formed with references thereon for identification from outside of said structure a location for each of said through cavities;

a first reference of said references on said plane major face identifying a first through cavity of said through cavities, said plane major face being configured to be broken at a location of said first reference to allow a removal of a first portion of said plane major face to allow access to said first through cavity from outside said structure;

said first through cavity is bounded by at least one inner frangible partition wall, said at least one inner frangible partition wall being continuous such that said first cavity avoids communication through said at least one inner frangible partition wall with a second through cavity of said cavities or with said outside of said structure.

2. The building element according to claim 1, wherein said plane major face has ribbings, and said references comprise interruptions of said ribbings aligned axially with said through cavities.

3. The building element according to claim 1, wherein said internal through cavities are each formed with at least one inner frangible partition wall.

4. The building element according to claim 3, wherein said at least one inner frangible partition wall is parallel to said major face.

5. The building element according to claim 1, wherein said dovetailed projections can be engaged by a complementary closing element of said opposite major face.

6. The building element according to claim 1, wherein each of said dovetailed projections is formed with a generally central vertical recess.

7. The building element according to claim 1, wherein said building element has a thickness of 125 mm.

8. The building element according to claim 1, wherein said building element has a thickness of 250 mm.

9. The building element according to claim 1 further comprising a pair of further through cavities for insertion of possible reinforcement elements.

10. The building element according to claim 1, further comprising at least one pair of top and bottom recesses that can be engaged by respective vertical centering pin elements.

11. A building system comprising a plurality of building elements according to claim 1, and further comprising auxiliary vertical centering members between said building elements set on top of one another, and auxiliary horizontal-spacing members between said building elements set side by side.

12. The building system according to claim 11, wherein said building system further comprises accessory closing members for closing said opposite major faces of said building elements between the corresponding dovetailed projections.

13. The building system according to claim 12, wherein the masonry structures made therewith comprise a thickness between a minimum of 60 mm and a maximum of 460 mm.

14. The building element according to claim 2, wherein said internal through cavities are each formed with at least one inner frangible partition wall.

15. The building element according to claim 8, wherein said building element has a pair of further through cavities for insertion of possible reinforcement elements.

16. The building element according to claim 1, wherein said first through cavity comprises at least one of a wire, duct, wireway, and pipe located therein.

* * * * *